US005634730A

United States Patent [19]

Bobry

[11] Patent Number: 5,634,730

[45] Date of Patent: Jun. 3, 1997

[54] HAND-HELD ELECTRONIC PRINTER

[76] Inventor: Howard H. Bobry, 18416 Olympic View Dr., Edmonds, Wash. 98020

[21] Appl. No.: 554,042

[22] Filed: Nov. 6, 1995

[51] Int. Cl.[6] ..... B41J 3/39

[52] U.S. Cl. ..... 400/88; 346/143; 358/473

[58] Field of Search ..... 400/88, 120 HH; 358/473; 346/143

[56] References Cited

U.S. PATENT DOCUMENTS

| | | | |
|---|---|---|---|
| 3,656,169 | 4/1972 | Kashio | 346/1 |
| 3,767,020 | 10/1973 | Rowe | 197/1 R |
| 4,089,262 | 5/1978 | Supora | 101/35 |
| 4,168,533 | 9/1979 | Schwartz | 364/900 |
| 4,211,012 | 7/1980 | Alles et al. | 33/18 R |
| 4,377,741 | 3/1983 | Brekka et al. | 235/472 |
| 4,436,439 | 3/1984 | Koto | 400/126 |
| 4,450,454 | 5/1984 | Koto | 346/140 R |
| 4,611,246 | 9/1986 | Nihei | 358/256 |
| 4,663,639 | 5/1987 | Owen et al. | 346/140 R |
| 4,673,303 | 6/1987 | Sansone et al. | 400/126 |
| 4,700,791 | 10/1987 | Iwasaki | 400/61 |
| 4,712,929 | 12/1987 | Kitaoka | 400/61 |
| 4,740,799 | 4/1988 | Mason et al. | 346/140 A |
| 4,748,460 | 5/1988 | Piatt et al. | 346/140 R |
| 4,758,849 | 7/1988 | Piatt et al. | 346/140 R |
| 4,819,083 | 4/1989 | Kawai et al. | 358/294 |
| 4,883,491 | 11/1989 | Mallory et al. | 623/22 |
| 4,901,164 | 2/1990 | Kurosawa | 358/473 |
| 4,928,183 | 5/1990 | Yajima | 358/296 |
| 4,949,283 | 8/1990 | Yamauchi et al. | 364/519 |
| 5,012,349 | 4/1991 | de Fay | 358/296 |
| 5,013,895 | 5/1991 | Iggulden et al. | 235/110 |
| 5,063,451 | 11/1991 | Yanagisawa et al. | 346/143 |
| 5,083,814 | 1/1992 | Guinta et al. | 283/70 |
| 5,093,675 | 3/1992 | Koumura et al. | 346/143 |
| 5,099,256 | 3/1992 | Anderson | 346/1.1 |
| 5,240,334 | 8/1993 | Epstein et al. | 400/88 |
| 5,311,208 | 5/1994 | Burger et al. | 345/163 |
| 5,325,118 | 6/1994 | Zybin et al. | 347/47 |
| 5,343,227 | 8/1994 | Hirosawa et al. | 349/42 |

*Primary Examiner*—Edgar S. Burr
*Assistant Examiner*—Steven S. Kelley
*Attorney, Agent, or Firm*—Rankin, Hill, Lewis & Clark

[57] ABSTRACT

A hand-held and self contained electronic printing device for printing indicia on a medium includes a housing that can be manually positioned adjacent a surface of the medium and remain stationary against the medium during a printing sequence; the housing having an aperture that generally defines a printing area on the medium when the housing is in position for printing; a printer disposed in the housing for printing indicia in a selectable pattern of dots on the medium within the printing area; an actuator for initiating a printing sequence; and electronic control means disposed in the housing for controlling the printer to print indicia on the medium during a printing sequence. In one embodiment, the print head can be moved to sweep across a printing area by a manual force applied to an actuator.

55 Claims, 17 Drawing Sheets

HAND-HELD ELECTRONIC PRINTER

BACKGROUND OF THE INVENTION

The invention relates generally to methods and apparatus for printing and recording indicia and information on a medium such as paper, for example. More particularly, the invention relates to fully self contained and hand-held printing apparatus that can be manually actuated by, for example, a hand stamping motion.

Mechanically actuated stamping devices are well known and are commonly used for imprinting various types of indicia and information on a medium. Such information can include sequential numbers, dates, text, images and so on. Mechanical hand operated stamping devices, although used for many years, are fairly limited in their flexibility and convenience such as changing the information to be printed. Electronic stampers and hand-held printers known heretofore, including electronic printers that are operated with a sweeping motion across the medium, have required external input functions, such as from a remote computer, for example, have been limited in the quantity, single line output, type and variety of information that can be printed, and can exhibit considerable image distortion. Additionally, a conventional stationary printing device generally uses an electrically driven print head that traverses the medium parallel to the printed surface. The use of an electric motor or similar drive device increases substantially the power consumption of the apparatus, which is undesirable for any hand-held and operated unit.

The objectives exist, therefore, for better and more reliable and more efficient apparatus and methods for hand-held and operated fully self contained printers. For printing apparatus that will be used in place of conventional mechanical stampers it is desirable that such devices mimic the hand stamping motion and feel of a mechanical stamper, and further utilize a manually driven mechanical actuator to displace the print head, thereby reducing the power consumption of the apparatus.

SUMMARY OF THE INVENTION

To the accomplishment of the foregoing objectives, the present invention contemplates, in one embodiment, a hand-held and self contained electronic printing device for printing indicia on a medium, comprising a housing that can be manually positioned adjacent a surface of the medium and remain stationary against the medium during a printing sequence; the housing having an aperture that generally defines a printing area on the medium when the housing is in position for printing; a printer disposed in the housing for printing indicia in a selectable pattern of dots on the medium within the printing area; an actuator for initiating a printing sequence; and electronic control means disposed in the housing for controlling the printer to print indicia on the medium during a printing sequence.

These and other aspects and advantages of the present invention will be readily understood and appreciated by those skilled in the art from the following detailed description of the preferred embodiments with the best mode contemplated for practicing the invention in view of the accompanying drawings.

DETAILED DESCRIPTION OF THE INVENTION

Figure 1:
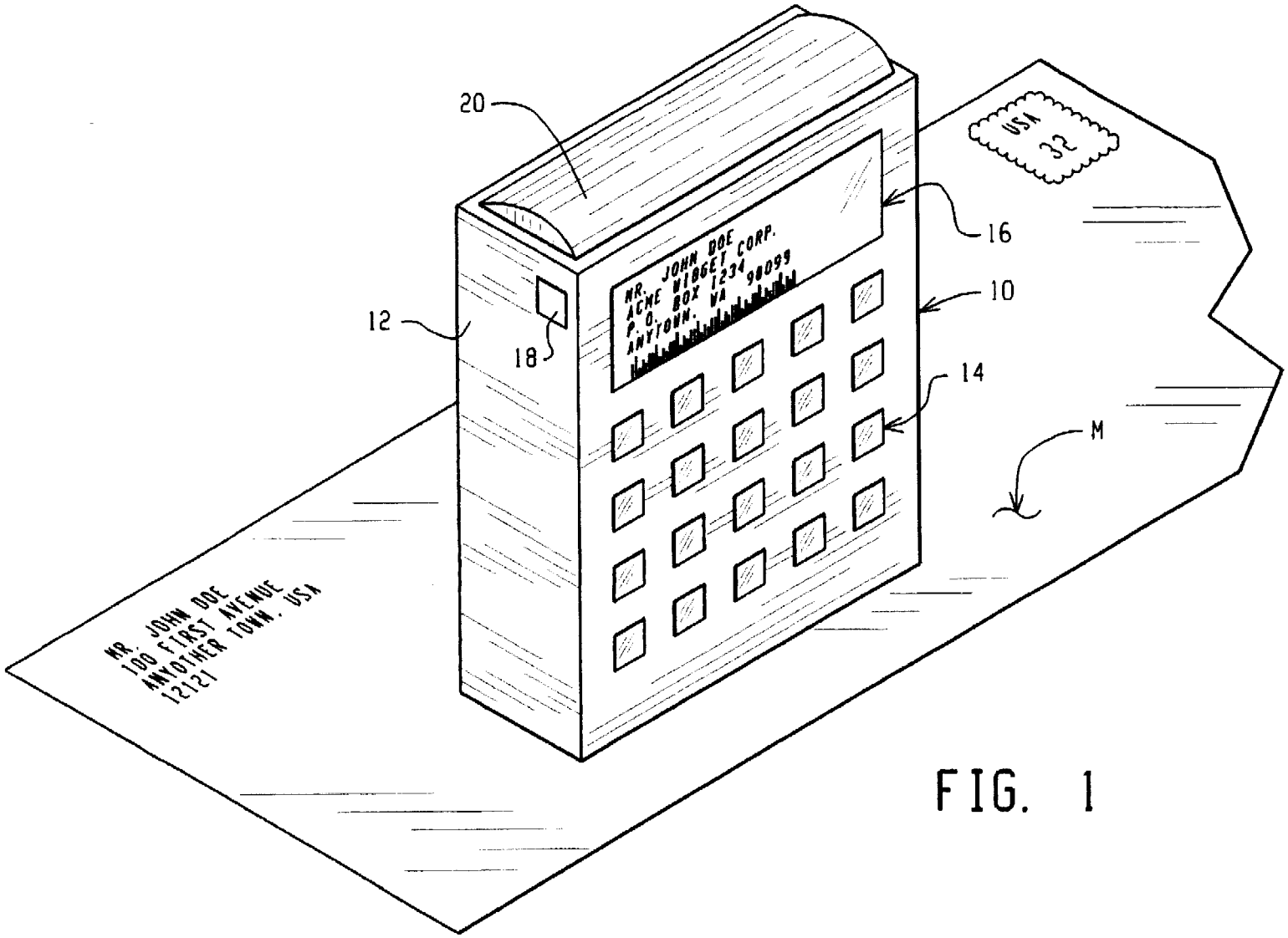
FIG. 1 is a simplified schematic perspective of a self contained and hand operated printing apparatus according to the present invention.

With reference to FIG. 1, an embodiment of the invention is illustrated in simplified schematic form for purposes of describing the basic concepts of the invention. In this basic configuration, a hand-held and operated printing apparatus 10 is illustrated. A significant feature of this apparatus is that it is a completely self contained unit that can be manually operated in an autonomous manner without an external connection. However, as will be explained hereinafter, the apparatus 10 is equipped with interface devices, which can be hardwired connectors or wireless links, to permit external data entry and/or control if so desired for a particular application.

In the embodiment of FIG. 1, the apparatus 10 is shown disposed on a medium, M, in this case a paper envelope. Although the invention is described herein with specific reference to printing on a flat web of paper, such as an envelope, sheet paper, and so on, such description is exemplary for purposes of illustration and explanation and should not be construed in a limiting sense. Those skilled in the art will readily appreciate that the invention can be utilized for printing indicia, images, bar codes, text and so on in virtually any color, as well as black or white, on any medium that is compatible with the selected printer mechanism used in the apparatus 10. The printer mechanism can be selected from any number of commercially available units, or special made, depending on the particular application. In the exemplary embodiments described herein; the printer mechanism is an ink jet type printer, sometimes referred to as a bubble jet printer, such printers being generally of the type that emits, projects or ejects ink through a number of nozzles, in response to electrical control signals, so that each individual ink projection produces a dot on the print medium. In many applications of the invention, other print mechanisms both known and later developed will also be suitable for use with the present invention.

The apparatus 10 includes a housing 12 which for convenience may be made from metal, plastic, composites or other suitable material. The housing 12 preferably is a rigid structure that is capable of supporting a printing mechanism therein along with an electronics package and an internal power supply, such as a battery. The housing 12 should also be sturdy enough to withstand manual forces applied to the structure to actuate the apparatus without damage or stress. The housing 12 should also provide a stable platform so that the apparatus 10 can be positioned adjacent the medium M, as illustrated in FIG. 1, for example, without sliding or moving on the medium during a printing sequence. Although the embodiment of FIG. 1 (and the detailed Figures associated therewith) are described with respect to a manually actuated apparatus in which a manual force is used to move a print head, those skilled in the art will appreciate that an electrical or electromechanical drive mechanism could alternatively be used to translate the print head in a desired movement. A particular advantage of the use of a manually driven print head is the substantially reduced electrical power requirements for the overall apparatus 10. Furthermore, in some embodiments it may be desirable for the print head to remain stationary or fixed during a printing operation, rather than moving between first and second positions. Such an embodiment is shown and described, for example, with respect to FIG. 3 herein.

The housing 12 holds a key pad device 14, which for convenience can be a conventional push pad or thin membrane type key pad. The housing 12 also holds a display device 16 such as, for example, a conventional LCD or LED display. Internal to the housing 12 (not shown in FIG. 1) is a circuit board or boards which hold the various electronic components and power supply components for operating the electronic printing apparatus 10. Part of the control circuitry may include an interface device 18, such as, for example, a conventional transceiver, that transmits and receives data and/or instructions from a remote device (not shown) such as a personal computer, for example. A suitable transceiver device 18 is an infrared transceiver, although other communication links could be used such as RF, microwave, acoustic and so on.

An actuator 20 is provided on the top of the housing 12. In this embodiment, the actuator 20 is manually depressed which causes a manually applied force to be exerted against a mechanism within the housing 12 to cause movement or displacement of a print head during a printing operation or sequence, as will be described in detail hereinafter. Preferably, the manual operation of the actuator 20 mimics the feel of a conventional non-electronic stamper. In the case where an electrical or electromechanical print head drive device is used, however, the actuator 20 can be realized simply in the form of an electrical contact switch to provide an input to the control electronics to command a printing operation. Furthermore, in some embodiments it may be desired to have a stationary print head inside the housing 12. In such a case, the actuator 20 again could be used to provide an electrical control signal to initiate a printing sequence without producing a physical displacement of the print head.

Figure 2:
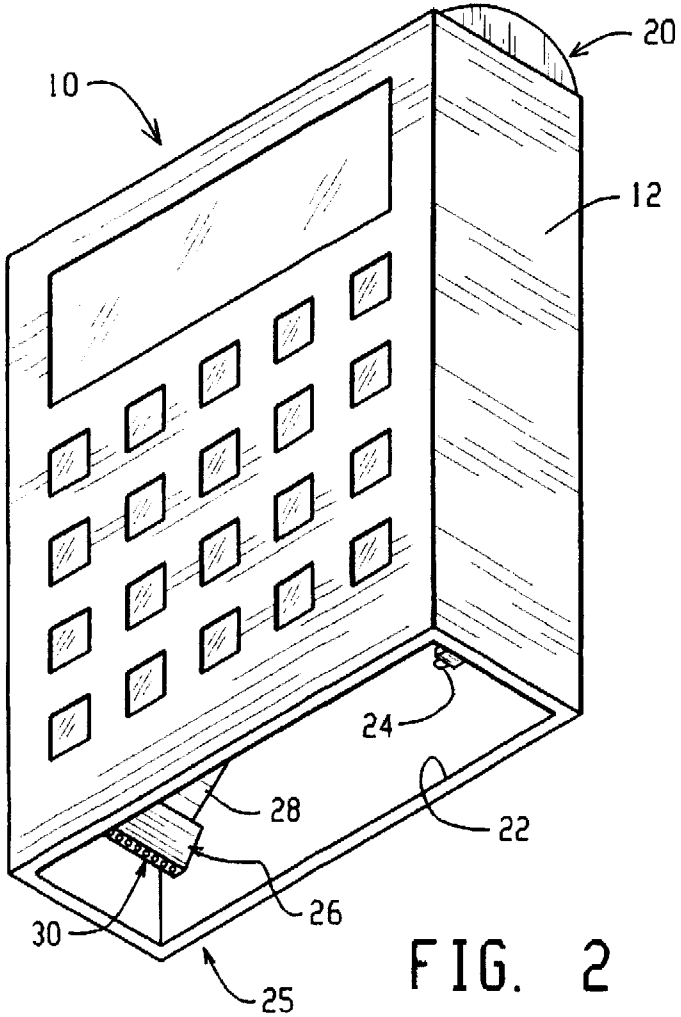
FIG. 2 is bottom view perspective of the apparatus of FIG. 1 illustrating use of a movable print head.

As best illustrated in FIG. 2, the bottom of the housing 12 includes an aperture 22 through which printing is accomplished by a printer mechanism 25 while the apparatus 10 is positioned adjacent the medium. Although not shown in the drawings, the housing 12 can be adapted in a known manner to include a removable cover that protects the printing mechanism when not in use. A reflective photosensor 24 is mounted near the aperture 22 and provides an output signal that indicates that the apparatus 10 is correctly positioned adjacent the medium. The photosensor 24 output is used as an inhibit signal to prevent operation of the printer if the apparatus 10 is not properly positioned next to the medium, thereby preventing accidental or unintended operation of the printer such as when the apparatus is being inspected or transported, for example.

Note in FIG. 2 that the printer mechanism 25 includes a print head 26 which is attached to a support member 28. In this embodiment, the support member is in the form of a flexible or spring-like element. The print head 26 in this example consists of a single row of ink jet nozzles 30 which are represented schematically in FIG. 2 by a row of dots. If desired for a particular application, additional rows of nozzles can be used, particularly for color printing. Additional print heads can also be used. The width of the print head 26 generally defines the height of the printing area on the medium. The spring-like support member 28 is used to move the print head 26 across a length-wise portion of the aperture 22, as will be described more fully hereinafter. Thus, the total printing area for the embodiment of FIG. 2 is generally delimited by the size of the aperture 22. Alternatively, the print head 26 can be arranged to travel in the width wise direction (using FIG. 2 as a reference), by using a wider print head with more nozzles. In some applications, the advantage of a shorter travel distance may offset the disadvantage of the increased number of nozzles.

Figure 3:
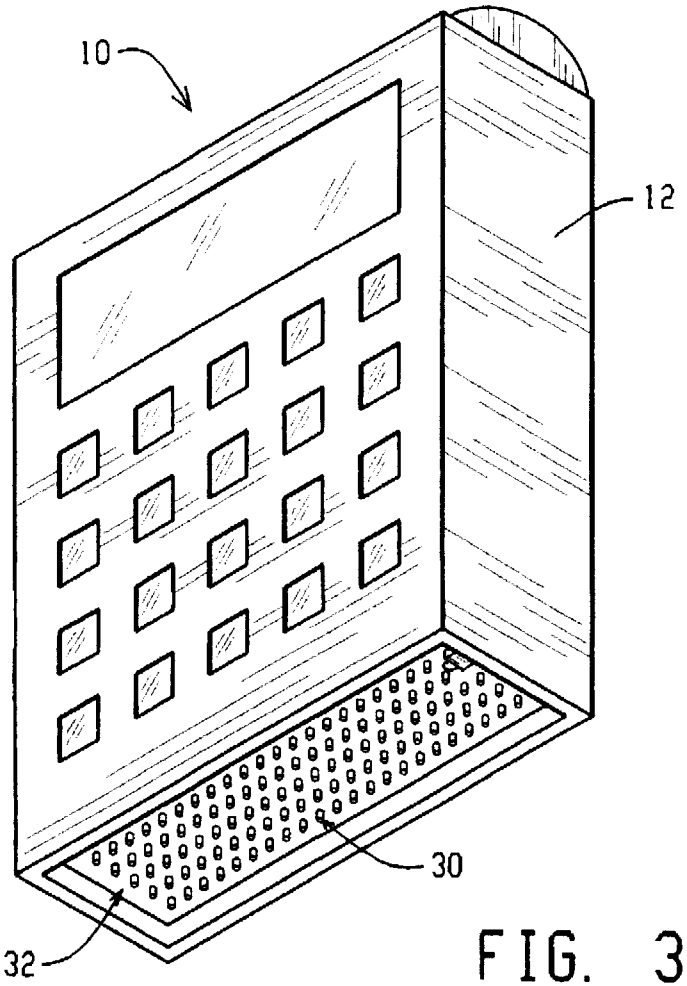
FIGS. 3–5 illustrate alternative embodiments of the apparatus of FIG. 1 which use a stationary print head.
Figure 4:
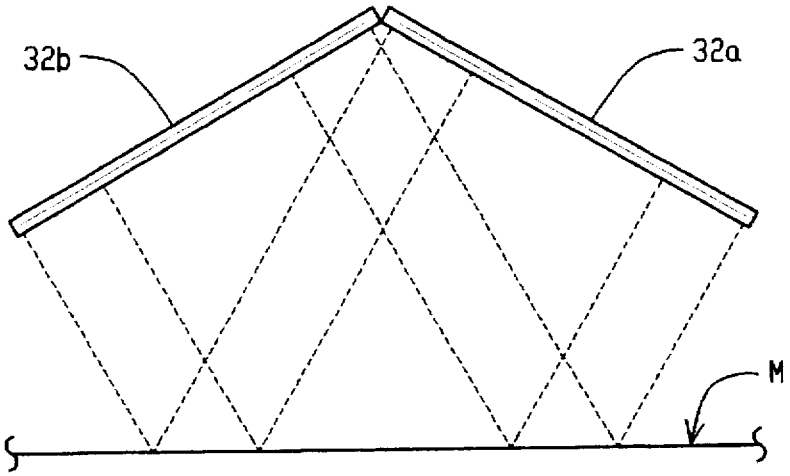
Figure 5:
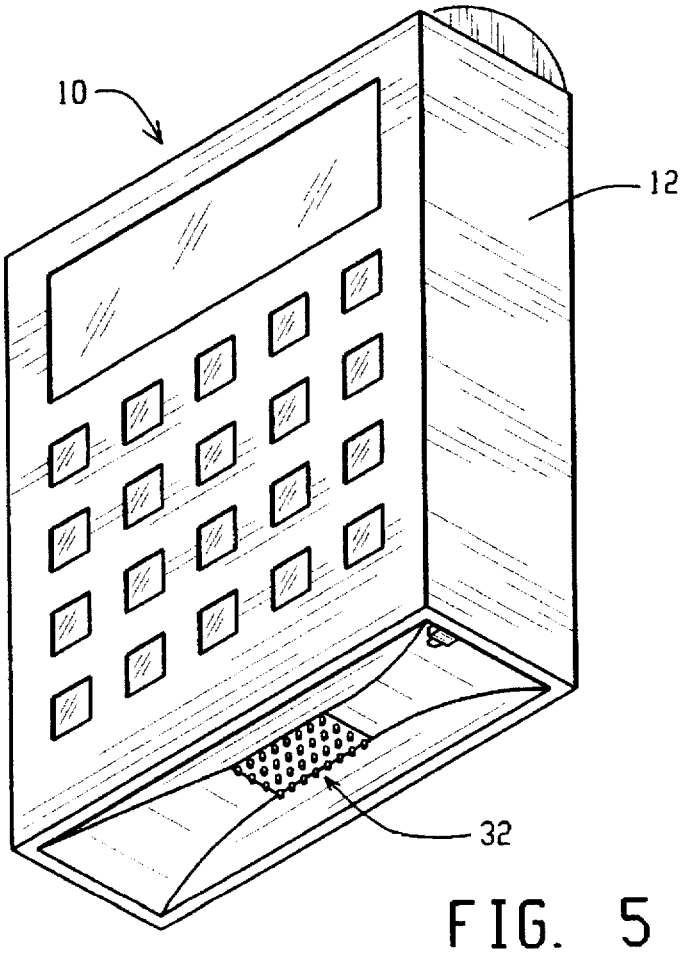

With reference to FIG. 3, an alternative embodiment is illustrated which uses a print head 32 that remains stationary within the housing during a printing operation. In this case, the stationary print head 32 includes a plurality of ink jet nozzles 30 arranged in a series of generally parallel rows and columns across the aperture 22. A suitable print head configuration is shown in U.S. Pat. No. 5,325,118 issued to Zybin et al., the entire disclosure of which is incorporated herein by reference. The nozzles 30 project ink in generally parallel trajectories with respect to each other towards the medium. Besides a single large area print head 32 as in FIG. 3, a plurality of smaller individual print heads could be used. As a further alternative illustrated in FIG. 4, the individual print heads **32*a* and 32*b* are angled so that each print head projects ink across the entire printing area. This arrangement would facilitate multi-color printing, for example. In the embodiment of FIG. 4, the print heads 32*a* and 32*b* can be controlled so that only one of the print heads is ejecting ink at any given time, thus eliminating collisions between ink drops emitted by the print heads. As further illustrated in FIG. 5, the stationary print head 32 can be made smaller than the print area on the medium, with each nozzle 30 disposed on the head 32** such that it projects ink toward the medium at a fixed and predetermined angle. Thus, the nozzles will generally project ink on non-parallel diverging trajectories with respect to each other.

Figure 6:
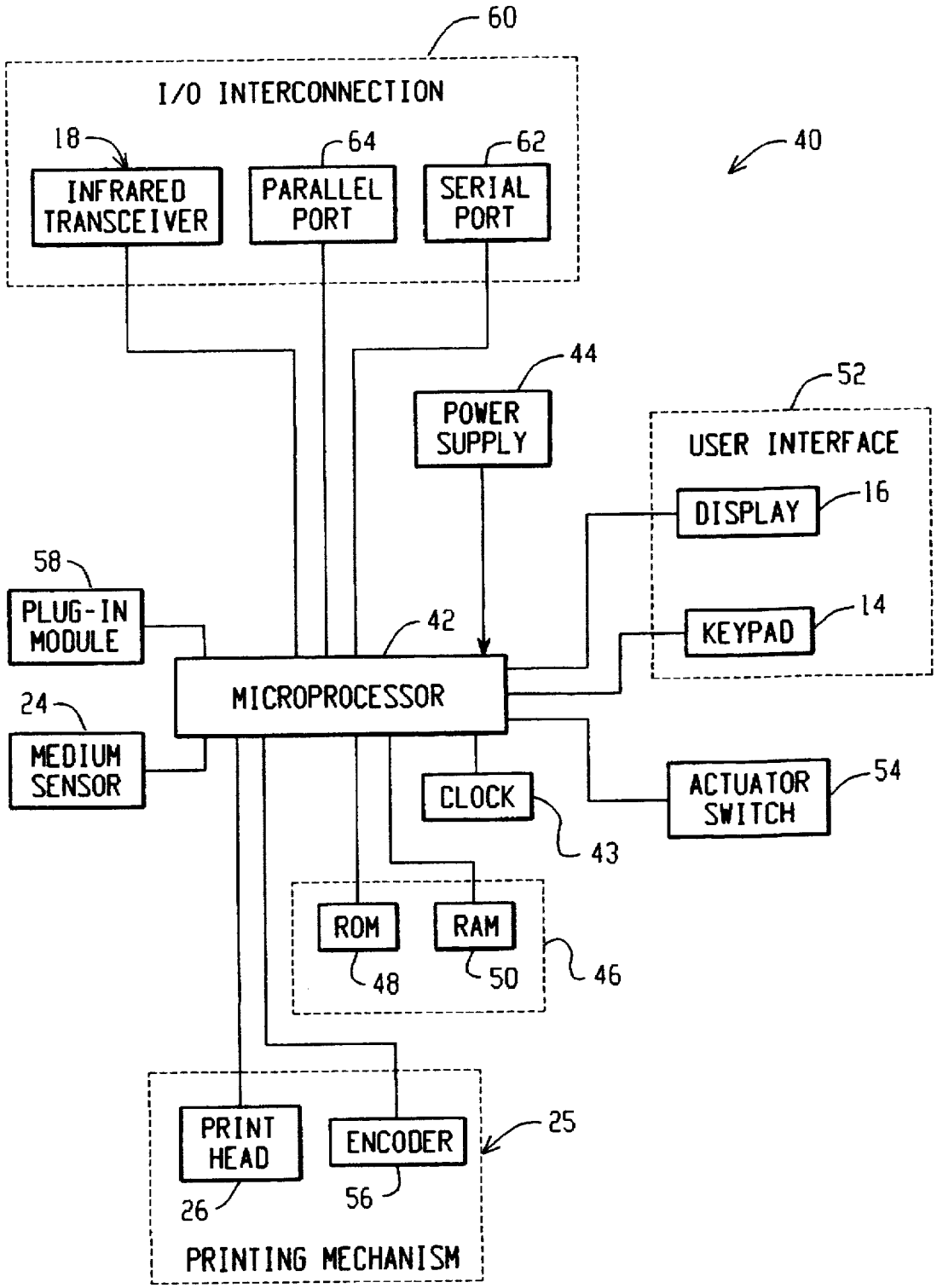
FIG. 6 is an electrical schematic diagram of a control circuit suitable for use with the printer apparatus of FIG. 1.

With reference next to FIG. 6, there is shown in simplified block diagram form a control circuit 40 suitable for use with all the embodiments of the present invention described herein. Those skilled in the art will readily appreciate that many of the features of this control circuit 40 are optional and can be used or omitted as desired for a particular application. The functions included in the embodiment of FIG. 6 is not exhaustive, and the designer can modify the circuit 40 to include additional control functions as needed for a particular application. Furthermore, although the circuit 40 is described in terms of a microprocessor based system, the invention can conveniently be practiced with the use of a microcontroller, microcomputer, digital signal processing, application specific integrated circuit (ASIC) and discrete logic circuits depending on the overall complexity of the control functions for a particular application.

In FIG. 6, a microprocessor 42 is connected to a number of peripheral circuits, and is used to provide the overall control function for the apparatus 10. A significant feature of the invention is that the apparatus 10 is a wholly self contained and operational hand-held printer that does not require the use of external inputs and controls. Thus, all of the circuits in FIG. 6 are fully contained within the housing 12. However, provision is made for external connection should such a configuration be desired for a specific application. The microprocessor 42 is programmed in a conventional manner according to the manufacturer's instructions, as is well known to those skilled in the art. A suitable microprocessor is part no. MC6800 available from Motorola Incorporated. For embodiments that utilize additional control and processing functions, it may be desirable to use a more powerful microprocessor such as part no. NS486SXF available from National Semiconductor, Inc.

A system clock 43 provides timing pulses at regular intervals for the operation of the system, including tracking current time and date information. A replaceable or rechargeable battery type power supply 44 provides system power for the microprocessor 42 and all other circuits within the housing 12. Manual displacement of the print head 26 substantially reduces the power requirements of the apparatus 10 compared to systems that use an electrically driven print head.

The microprocessor 42 accesses program instructions and data via a memory circuit 46 which includes a non-volatile ROM memory 48 and a suitable volatile temporary memory, such as a RAM memory 50. The ROM is used to store control programs, conversion tables and the like for the microprocessor 42, as well as fixed information such as commonly printed phrases such as "RECEIVED" or "FAXED", or graphics images including bar code images and other indicia. The RAM is used to store system data produced during operation such as an activity log, where the log may include, for example, information that was printed, identification of the source, date and time of the printing. The RAM 50 can also be used to accumulate a running total of the number of dots printed, with the total being reset to zero each time the ink supply associated with the print head 26 is replenished or replaced. By comparing the total number of dots that can be printed using the ink supply, with the actual number of dots printed since the supply was last filled, the microprocessor 42 can generate a warning that the ink supply is low, for example, at about 5% capacity. The RAM can further be used to store programs, instructions and data entered manually by the operator through a user interface 52, or received from an external source such as a computer through an I/O device 60, or the results of calculations performed by the microprocessor 42. These calculations may include coordinate conversions, distortion compensation, data used to generate bar codes, and so on. Those skilled in the art will readily appreciate that the volatile memory 50 can also be realized in the form of a FIFO memory, for example. The particular hardware selected for use in realizing the various components of the control circuit 40 will depend on the specific system requirements needed or desired.

A user interface circuit 52 includes the visual display 16 and the key pad 14. The display 16 is used to view the print image prior to printing, as illustrated in an exemplary manner in FIG. 1. The display 16 can also be used to communicate warnings (such as low ink supply or low battery), status information or a prompt to request data entry. The key pad 14 is used, for example, for selecting items to be printed from a menu displayed by the apparatus 10, or for creating indicia to be printed, as well as for data entry and command inputs.

An actuator switch 54 is provided to initiate a printing sequence or operation. As used herein, the terms "printing sequence" and "printing operation" are used interchangeably to simply refer to the steps carried out between actuation of the apparatus 10 and completion of a printing function on the medium. In configurations where a mechanical force is applied to move the print head 26 across the printing area on the medium, the switch 54 can be omitted because a position encoder 56 is used to signal the microprocessor 42 to start a printing operation. In configurations where the print head 32 remains stationary, or where an electric or electromechanical device is employed to translate the print head 26 across the printing area, the switch 54 can be used to signal to the microprocessor 42 that printing is to begin.

A plug-in module 58 is provided so that information, instructions, or programs may be transferred between the apparatus 10 and an external source such as, for example, a computer. The module can be, for example, an industry standard PCMCIA card.

A communication link to an external apparatus is accomplished by use of an I/0 device 60 such as a serial port 62, a parallel port 64 or a wireless link such as an RF transceiver, or the infrared transceiver 18, an acoustic transducer or a modem. The transceiver 18 may be, for example, a Hewlett-Packard HSDL-1000 transceiver.

The medium sensor 24 includes a circuit for producing an output signal that is sent to the microprocessor 42 when the apparatus 10 is properly positioned adjacent the medium.

The apparatus 10 further includes the printing mechanism 25, which in the exemplary embodiment includes an ink jet print head 26 and a print head position encoder 56. The encoder 56 can be, for example, Hewlett-Packard device HEDR-8000. This encoder produces two output pulse channels in quadrature relationship such that both magnitude and direction of rotation (of the encoder sensing element) are detected. Because the nozzles 30 are fixed in the print head 26, position and movement data of the print head 26 can be easily converted into position data for each nozzle 30 on a real time basis. Further, with the orientation of each nozzle 30 being a known quantity relative to the medium, the nozzle position information can be used to determine the exact location on the medium to which each nozzle will project a dot during a printing sequence. Those skilled in the art will appreciate that for the embodiments described herein which use a stationary print head, the position encoder 56 can conveniently be omitted.

In the embodiments herein that use an ink jet print head, an image is formed on the medium by projecting a series of dots onto the medium in a selected pattern. In one embodiment, the dots can be ejected on a line by line basis (a "line" meaning a row or column of dots), so that the net visual effect of a plurality of lines is the desired image. The selection of nozzles activated for each line of dots will be determined in part by the indicia being printed. Other factors that affect the dynamic selection of the nozzles during a printing sequence will be further explained herein. Each printable indicia is digitally formatted on a line by line basis, in its simplest form as a series of on/off commands to each nozzle 30 under control of the microprocessor 42. The digitized representations of the indicia can be stored in the electronic memory 46, for example.

Figure 7:
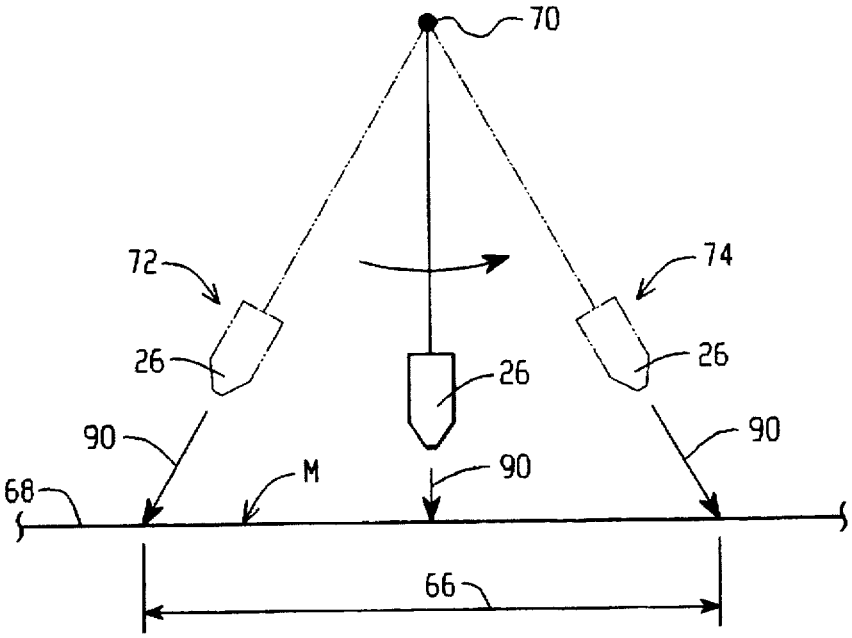
FIG. 7 is a simplified illustration of the use of a manually movable print head in accordance with the invention.

With reference next to FIG. 7, there is illustrated in simplified elevation the motion of the print head 26 for the embodiment of FIG. 2. In this embodiment, a full line (e.g. a full row or column of nozzles) type ink jet print head 26 is so disposed as to sweep over a selectable printing area 66 on a surface 68 of the medium M. The printing area 66 is selected by the operator manually positioning the aperture 22 over the desired location on the medium surface 68. Each printing operation can be accomplished either during a single or a double pass over the printing area 66. It is important to note from FIG. 7 that the print head 26 does not maintain a constant distance from the surface 68, nor will the nozzles 30 project ink droplets (represented by the lines 90 in FIG. 7) at a constant angle relative to the surface 68. Preferably, the print head 26 pivots about a point 70 between a first or home position 72 and a second or return position 74. In general, the first and second positions delimit the printing area 66, although the nozzles 30 can be individually and angularly disposed in the print head 26 to project ink droplets laterally beyond the print head 26. Alternatively, a drive mechanism can be used that translates the print head, for example, in a linear manner, rather than along an arc.

The position encoder 56 provides pulses to the microprocessor 42 as the print head 26 sweeps across the printing area 66. These pulses can be timed and counted, with the encoder count being either incremented or decremented depending on direction of movement, to provide both position and velocity information for the print head 26, and in particular the nozzles 30 disposed on the head 26. The microprocessor 42 software utilizes the nozzle 30 position and velocity information to determine when to activate each nozzle based on the desired indicia to be printed on the medium for the current printing sequence. The encoder 56 is coupled to the drive element that the print head is mounted on, in this example the spring-like support member 28 (FIG. 2) and can be configured, for example, to produce a pulse for each incremental change in angular displacement of the print head 26. By the convenient use of look-up tables, calculations or approximations, the angular displacement of the print head 26 can easily be converted to actual position data for each nozzle. In the case of an electrical drive mechanism for the print head 26, such as an electric motor, solenoid, voice coil actuator, stepper motor or other available devices, the command signals to the driver can be used for position and speed control, as can any suitable feedback indicators.

However, in accordance with another aspect of the invention, in some applications it is desirable to use a manually driven print head 26. This avoids the need for a driver that consumes electrical power. In the case of a manually driven print head 26, it is also desirable that the sweep motion be rapid and positive so that once the sweep motion is initiated it will be completed without further action being required of the operator.

Figure 8:
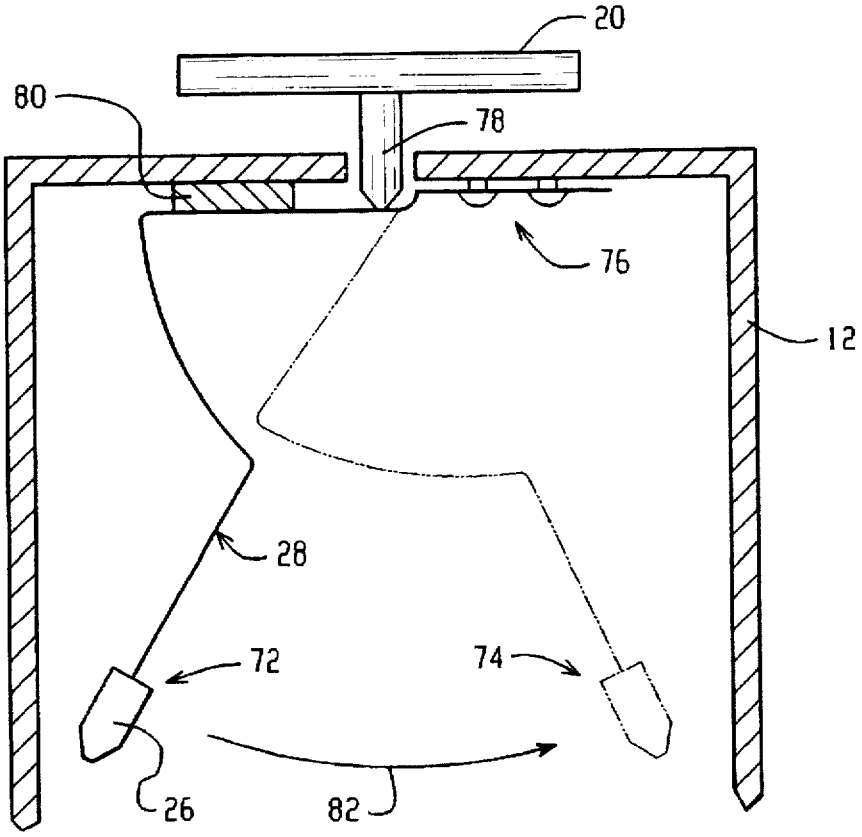
FIG. 8 is a simplified schematic of a manually operated print head drive mechanism for the apparatus of FIGS. 1 and 2.

With reference to FIG. 8, a mechanical and manually operated actuation arrangement is illustrated in simplified form. One of the general ideas embodied in the example of FIG. 8 is to provide a manual actuation that mimics the feel and operation of a conventional mechanical stamper in which a handle or lever or other member is manually acted on to produce a positive "stamping" effect. The housing 12 holds the print head 26 by means of the spring like member 28. The member 28 is fixedly attached at one end to the housing as at 76. The attachment at 76 can be accomplished by any convenient method such as rivets, screws, adhesives, a retaining bracket and so on. The actuator 20, in this case realized in the form of a handle that extends above the top of the housing 12, includes a post 78 that extends into the housing 12 into contact with the member 28. The post 78 is provided with a retaining element such as a snap ring (not shown), for example, to prevent the handle from falling out of the housing 12. A permanent magnet 80 is mounted in the housing 12 and retains the member 28 in the first or home position 72 prior to the application of manual force on the actuator 20. With no force applied to the actuator 20, the resilient spring-like member 28 acts to move the print head 26 to the first or home position 72 shown in FIG. 8. In order to initiate a printing operation, the operator presses down on the actuator 20 with enough force to displace the member 28 away from the magnet 80 as indicated by the directional arrow 82. The sudden release of the magnetic holding force results in the print head 26 fully travelling to the second or return position 74. After the operator releases the actuator 20, the member 28 returns the print head 26 to the home position 72.

Figure 9:
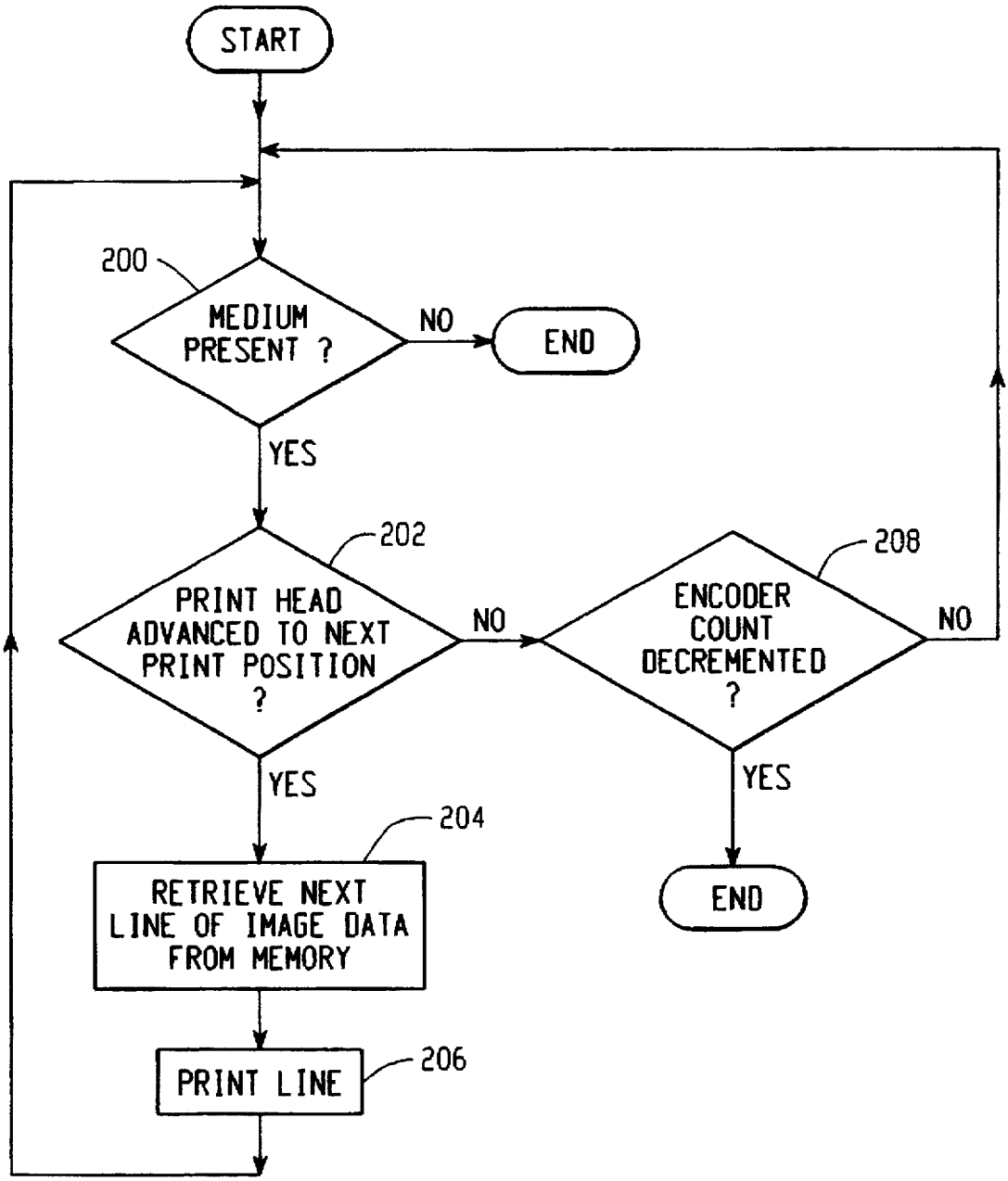
FIG. 9 is a flow chart for a control sequence of a printing operation in accordance with the invention for embodiments utilizing a manually movable print head.

The encoder 56 produces pulses from the moment that the member 28 is released from the magnet 80, thus causing the microprocessor to initiate the desired printing sequence. A representative sequence is illustrated in the software flow chart of FIG. 9. At step 200 the system confirms that the apparatus 10 is properly positioned adjacent the medium M by confirming the presence of the photosensor 24 output. At step 202 the system tests the encoder count to determine if the print head 26 has moved to the next print position, i.e. if the print head 26 has advanced to the initial point where printing is to start, or further advanced from the last print position by a distance corresponding to the pitch between successive lines of dots. If so, the data stored in memory representing the next line of dots forming part of the indicia to be printed is retrieved and printed at steps 204 and 206. Note that the medium present test at step 200 is repeated throughout a printing operation. When the encoder 56 count is decremented, as at step 208, indicating that the print head 26 has reversed direction and is moving back towards the first or home position 72, printing is terminated. Note that the actual printing of dots would have terminated previous to this step, as the last line of image data would correspond to a print head position at or before the second or return position 74. Alternately, the completion of printing tested at step 208 could be determined by the encoder count reaching some predetermined value, or by a determination that all lines of dots comprising a particular image had been printed.

Figure 10A:
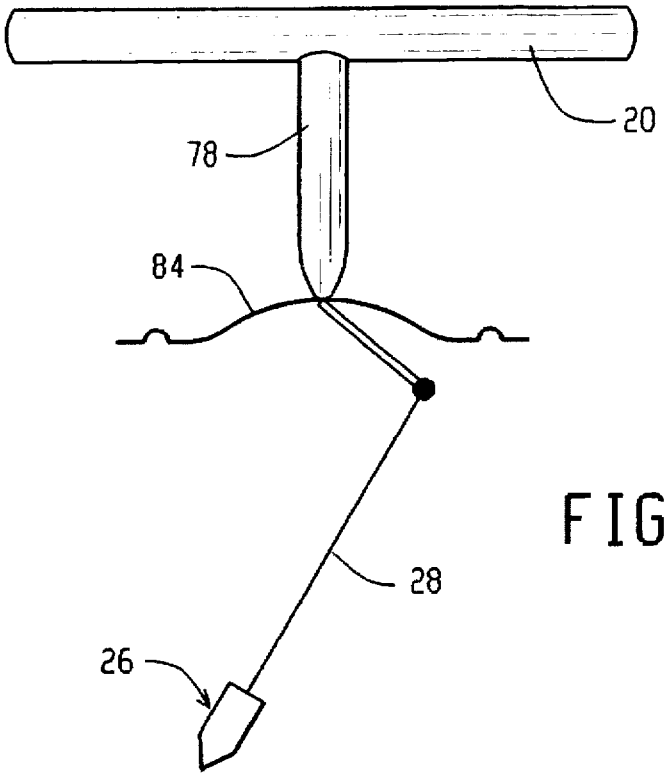
FIGS. 10A and 10B are simplified representations of another manually actuated print head drive mechanism.
Figure 10B:
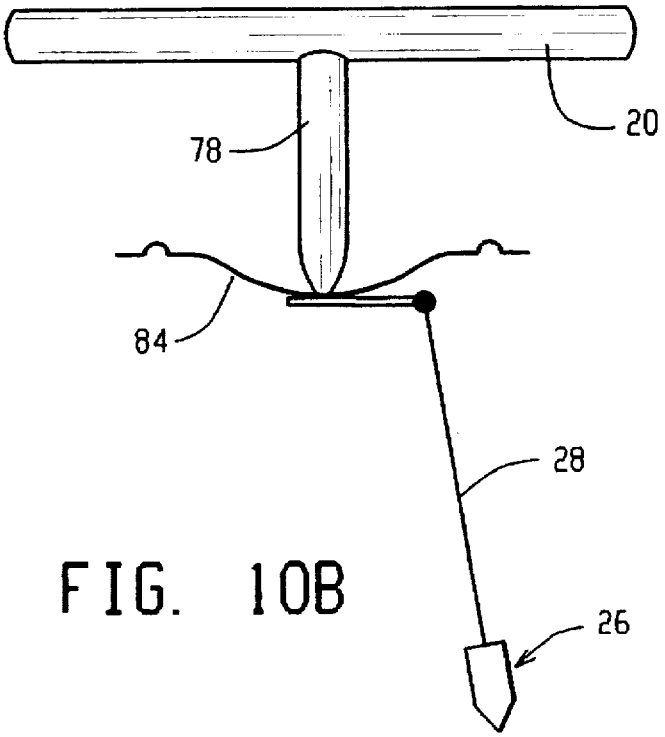

FIGS. 10A and 10B show an alternative embodiment of the manual drive mechanism. In this example, the magnet 80 is omitted and the support member 28 is attached at one end to a bi-stable spring 84. In this embodiment, the member 28 need not be a flexible or spring-like element because of the use of the bi-stable spring 84. FIG. 10A shows the print head 26 in the home position 72 and FIG. 10B shows the print head in the second or return position 74. When the actuator 20 is manually depressed, the bi-stable spring 84 suddenly concaves as shown in FIG. 10B and the member 28 pivots thus causing the print head 26 to sweep across the printing area 66. When manual force on the actuator 20 is released, the bi-stable spring 84 returns the member 28 and the print head 26 to the home position of FIG. 10A. Printing can be accomplished during either direction of travel or both. Additionally, for all the embodiments described herein, multiple print heads can be attached to the driving mechanism.

Figure 11:
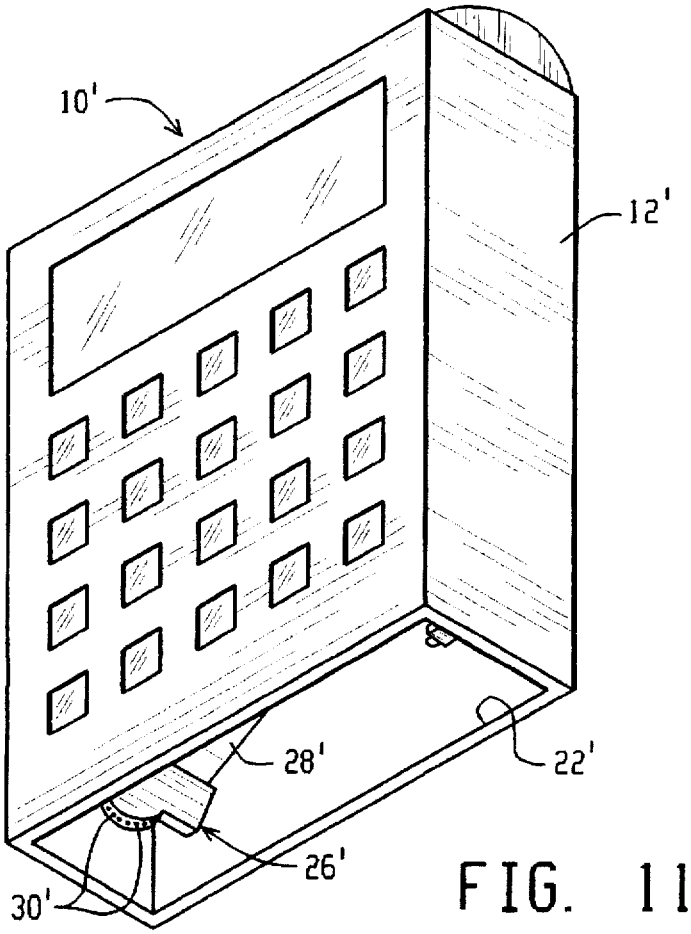
FIG. 11 is a bottom perspective of another embodiment of a printer mechanism suitable for use with the invention.

FIG. 11 illustrates another embodiment of a printer mechanism 25' equipped with a full line type ink jet print head 26' so disposed as to sweep over a printing area in a single pass upon actuation. (Throughout the various alternative embodiments described and illustrated herein, corresponding structures and components are assigned the same reference numeral followed by a prime (') mark, and a repeated detailed description of such structures is not required to understand and practice the invention.) The print head 26' is narrower than the printing area, with each nozzle 30' disposed such that it projects ink toward the medium at a set and predetermined angle such that the projected ink droplet reaches its intended point on the medium.

Note that this embodiment is similar to the embodiment of FIGS. 2 and 7 with respect to angular displacement of the print head 26' (a travel path that is generally non-parallel to the medium surface 68) and also can use a mechanical drive mechanism if so desired to provide a rapid and positive sweeping action. As in the previous described embodiments herein, multiple print heads may be mounted where one is shown and described, for purposes of printing in more than one color or increased resolution.

Figure 12:
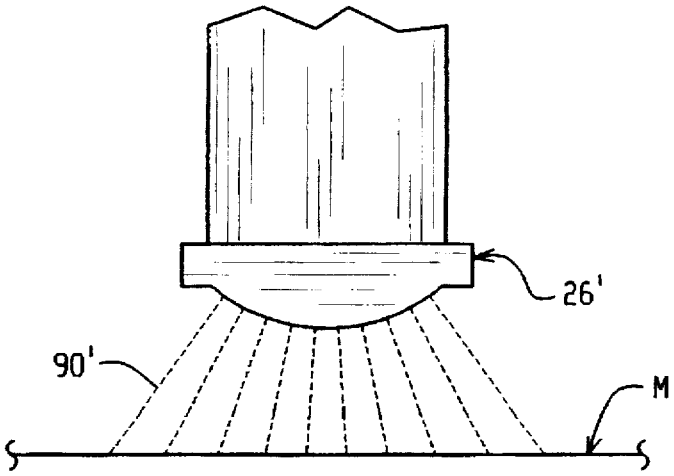
FIG. 12 is a schematic end view of a print head as used in the embodiment of FIG. 11.

Because the print head 26' is smaller than the actual printing area 66 on the medium, additional consideration should be given to the paths of projection of the ink from the various nozzles 30' FIG. 12 is a schematic end view showing in a representative manner the divergent angular projection of ink droplets from the print head 26' to the medium M. Note that each individual ink jet nozzle is oriented at an appropriate angle such that its respective ink droplet or spray 90' is projected to a desired position on the medium. The various nozzles project ink at diverging angles with respect to one another.

Figure 13:
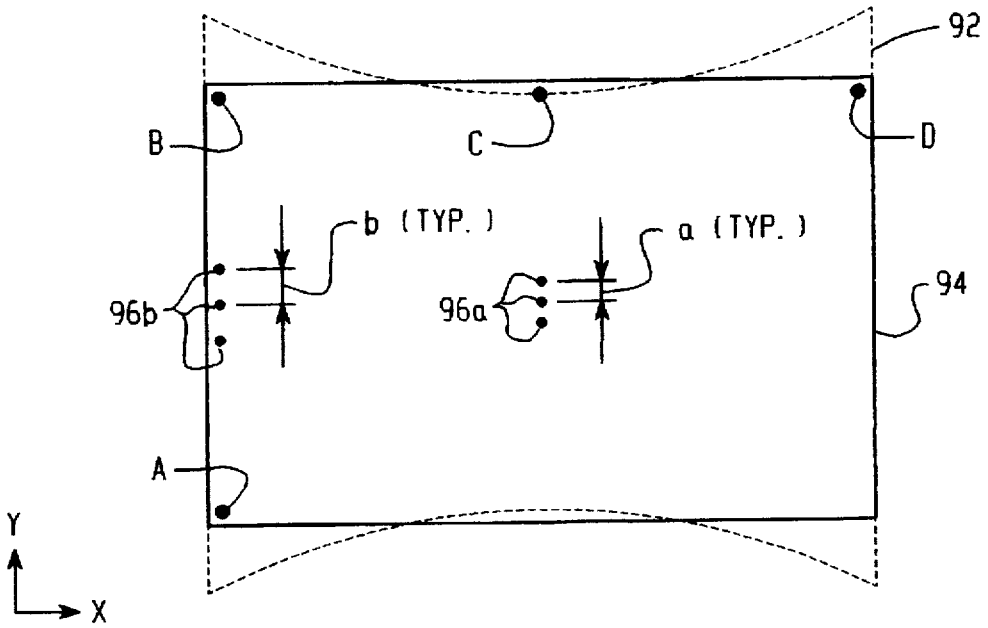
FIG. 13 is a representative illustration of a print area swept by the print head operation of FIG. 12.

FIG. 13 is a view of an uncorrected printing area 92 (shown with dashed lines) swept by the print head 26' in this embodiment. The printing area 92 is not the desired rectangle 94, but, rather, exhibits a broadening at each end, producing an "hour glass" shape, resulting from the angular projection of the ink droplets from the print head 26', combined with the varying distance of the print head 26' (due to the arcuate travel path) from the medium. At the center of the print head's sweep over the medium, the print head 26' is closest to the medium and deposits dots 96*a* with a pitch "a." At either end of the head's sweep, the distance of the print head 26' from the medium is at a maximum, and the same nozzles deposit dots 96*b* with a pitch "b" (shown exaggerated for clarity).

This distortion may be corrected by the control circuitry, specifically by the technique of mapping, or translating the specified coordinates of a dot to be printed to a new set of coordinates which compensates for the distortion which would otherwise be produced. In order to maintain a desired print resolution, or dot density, additional ink jet nozzles can be provided in the print head 26' so that the desired resolution is achieved at the ends of the sweep, where the projected dots are at a maximum pitch.

Figure 14:
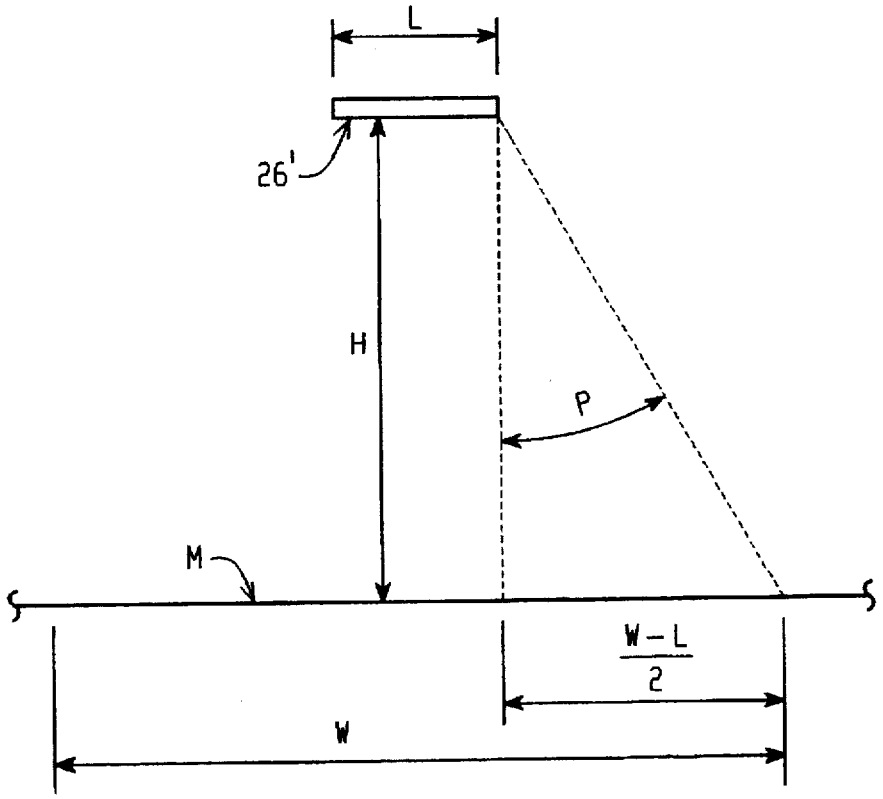
FIGS. 14 and 15 are geometric illustrations of various parameters that influence appearance and distortion of a printed image.

This process may be best explained by way of example. With reference to FIG. 14, a print head 26' with a length "L" is sweeping above a medium M at a height "H," having a printing area with a width "W." This is an end view, looking in the direction of motion of the print head 26' (i.e. the print head moves arcuately through the plane of the drawing), with the print head 26' at mid sweep, so "H" represents the shortest distance from the print head 26' to the medium. Each of the two outermost nozzles (one on each side of the print head) projects ink droplets at an angle "p" to the perpendicular as shown. Angle "p" may be calculated as: $p=\arctan[{}^{(W-L)/2}/H]=\arctan[{}^{(W-L)}/2H]$. Note that while FIG. 12 shows a print head 26' having nozzles disposed about a curved surface, FIG. 14 assumes a flat surface. This difference is immaterial to the calculations presented here, so long as the value of "H" utilized is that of each particular nozzle in question.

Figure 15:
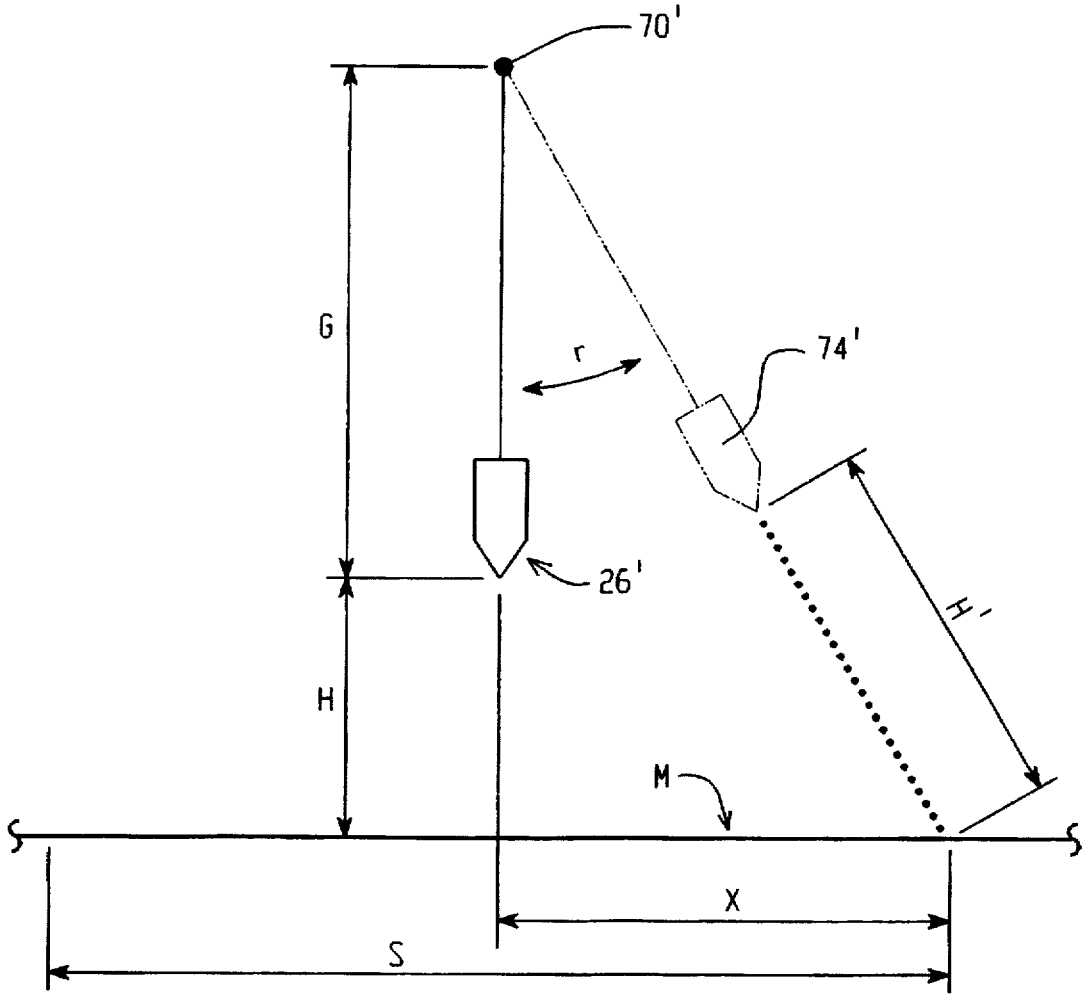

FIG. 15 shows graphically a side view of the same print head 26' which sweeps over a print area of length "S" on the medium. "X" is the displacement of the projected ink droplets from the center of the sweep. At the farthest extent of the sweep, X=S/2 and the print head is at the position designated by the numeral 74'. The distance from the point about which the print head sweeps, or the pivot point 70', to the print head nozzles is "G." The sweep angle, "r," may be calculated as:

$$r=\arctan({}^{X}/(G+H))$$

The distance over which the ink droplets are projected is no longer "H," but "H'," where $H'={}^{(G+H)}/\cos r)-G$, and print area width is no longer "W," but "W'," where $W'=L+2H'*\tan p=L+2*[({}^{(G+H)}/\cos r)-G]*({}^{(W-L)}/2H)$; or $W'=L+[({}^{(G+H)}/\cos r)-G]*({}^{(W-L)}/H)$ For purposes of example, assume that the print area is to be 2" wide by 3" long, or W=2 and S=3. Further, assume that the print head is 1" wide (L=1), G=3, and H=0.5. Then:

$W'=1+[({}^{3.5}\cos r)-3]*2$, or $W'=({}^{7}/\cos r)-5$

At the maximum sweep, X=1.5 (X=S/2), so r=23.2° maximum. As r sweeps from 0° to 23.2°, W' varies from 2.00" to 2.62".

Referring again to FIG. 13, assume for example that the maximum dot pitch desired is 0.01", for a print resolution of 100 dots per inch (dpi), so that b=0.010. Further assume that dot positions are identified as coordinates on a rectilinear grid having 300 points (0–299) in the "x" direction and 200 points (0–199) in the "y" direction. Dot A is at (0,0), dot B is at (0,199), dot C is at location (150,199), and dot D is at (299,199). With W'=2.62", a print head 26' having 262 nozzles is required. These nozzles are each designated by a position number (0–261) counting in the "y" direction.

In order to print dots A and B at points (0,0) and (0,199), respectively, nozzles 31 and 230 are utilized, rather than nozzles 0 and 199. Dot C is printed using nozzle 261, and dot D is printed using nozzle 230. While the minimum print resolution is 100 dpi as required ("b"), resolution increases to 131 dpi at the center of the print sweep ("a").

Figure 16:
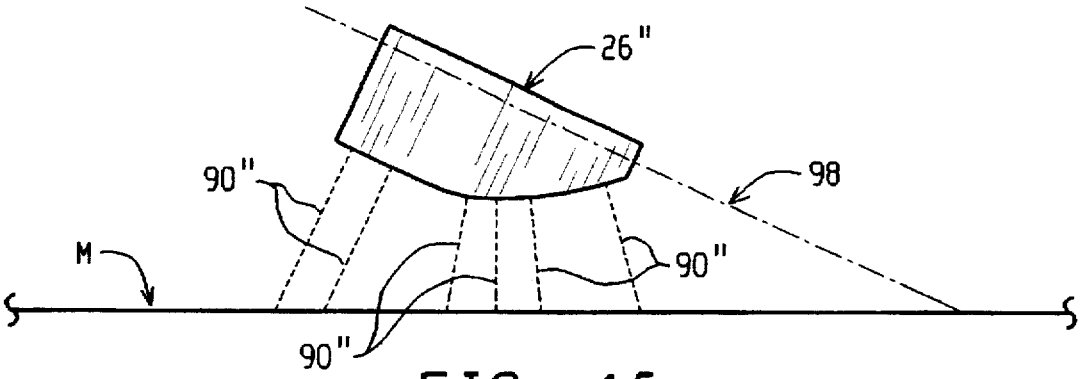
FIG. 16 is an alternative embodiment of the arrangement of FIG. 12, with a non-symmetrical print head rotating about an axis that is non-parallel to the print medium.

While the foregoing discussion has described the use of a symmetrical print head sweeping or scanning about an axis parallel to the medium, it is recognized both that a non-symmetrical print head may be used, and sweeping or scanning may be about an axis not parallel to the medium. This is illustrated in FIG. 16, wherein a non-symmetrical print head 26" is shown projecting ink droplets to a medium, while sweeping about a non-parallel axis 98. Any combination of a symmetrical or non-symmetrical print head, sweeping about a parallel or non-parallel axis, may be used, with the appropriate compensation made for the various projection angles of ink from the nozzles as set forth above.

Figure 17:
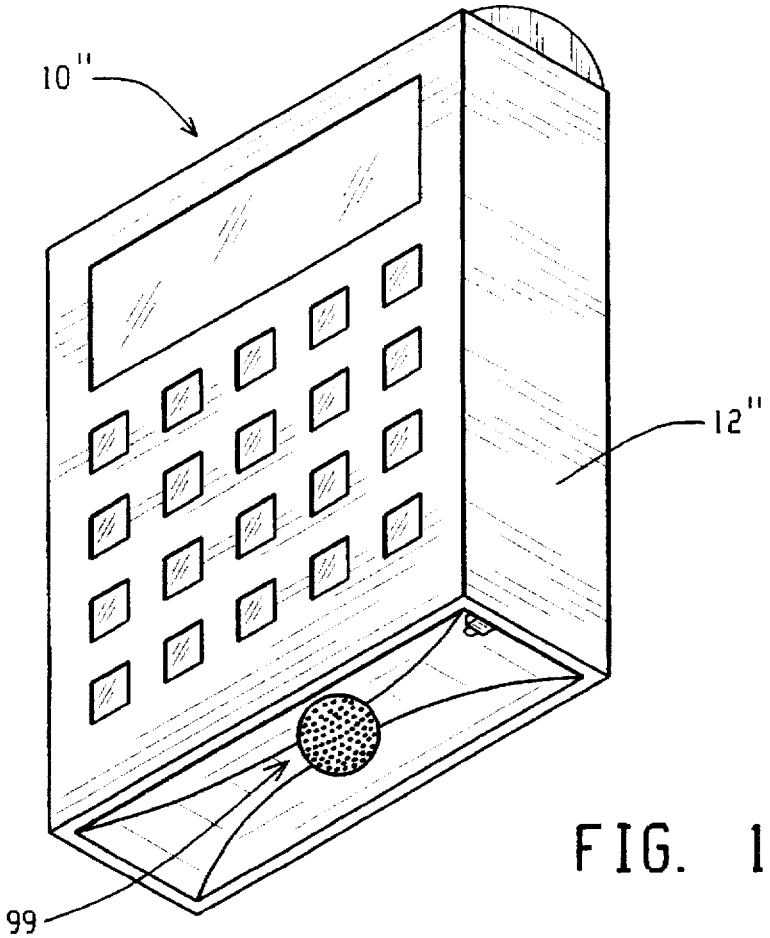
FIGS. 17–25 illustrate an alternative embodiment of a printing mechanism having a print head that rotates on an axis not parallel with the plane of the print medium.

FIG. 17 illustrates a bottom facing perspective of a printer apparatus 10" equipped with an ink jet print head 99 which rotates on an axis not parallel to, and in this case perpendicular to, the medium. Shown is a print head 99 of reduced width, with each nozzle disposed such that it projects ink toward the medium at a set and predetermined angle such that the projected ink droplet reaches its intended point on the medium. It is recognized that a print head having a width as great as the diagonal of the printing area could also be used.

Figure 18:
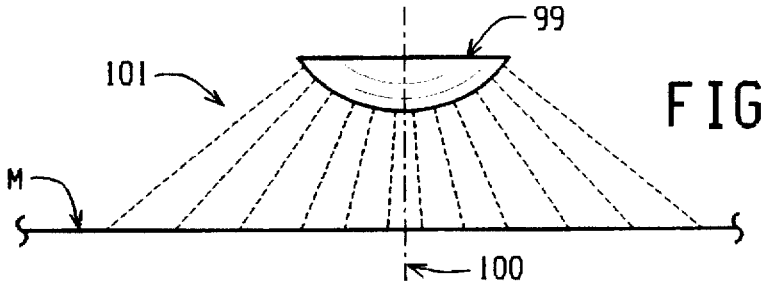
Figure 19:
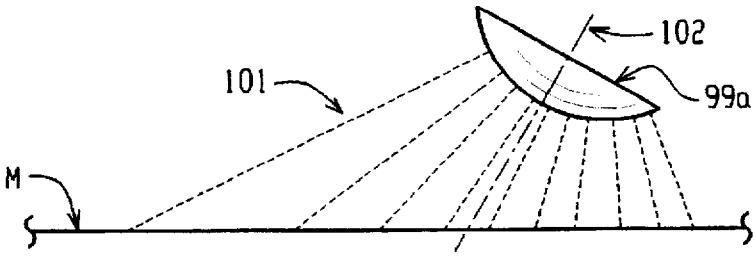

FIG. 18 is a schematic view showing the angular projection of the ink droplets 101 from the print head 99 to the medium, where the angle of projection of the ink droplets 101 from each nozzle may be computed using the same method as has been previously described with regard to FIG. 14, where "W" is the magnitude of the greatest swath to be covered by the print head 99. This will be the diagonal of the printing area when the print head 99 is mounted in the center of the printing area, but may be a lesser dimension when the print head is mounted elsewhere as will be later described. It is recognized that while FIG. 18 illustrates a print head 99 rotating about an axis 100 perpendicular to the medium, this is not a requirement. FIG. 19 illustrates a print head 99*a* disposed to rotate about an axis 102 not perpendicular to the medium.

Figure 20:
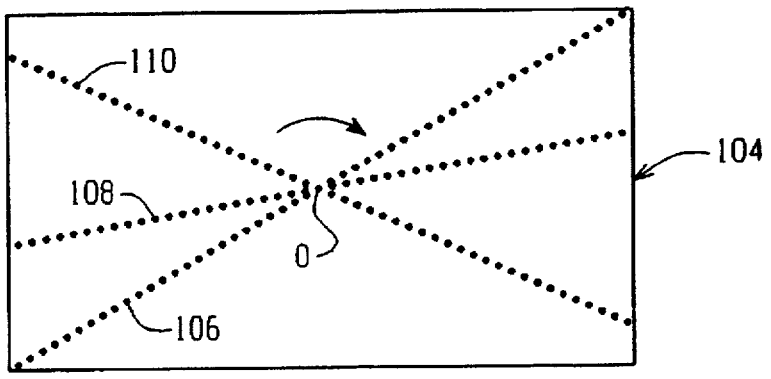

FIG. 20 is a view of the printing area 104, and three rows of dots 106, 108 and 110 are shown projected by the print head 99 as it rotates about an axis centered at "0" on the print area. It is apparent from FIG. 20 that this embodiment yields an array of dots or pixels laid out in a polar, rather than rectilinear, array, and dot coordinates are therefore mapped, or translated, from a rectilinear coordinate system as is typically used, to polar coordinates. This may be readily accomplished by the use of a look-up table, or by calculation, for example. A complete sweep of the print area uses a 180° rotation of the print head 99. The print head 99 may be rotated in the opposite direction, back to the starting position, at the conclusion of each printing, or, alternately, it may print bi-directionally such that it rotates clockwise for one printing, then counter-clockwise for the next printing, and so forth.

Figure 21:
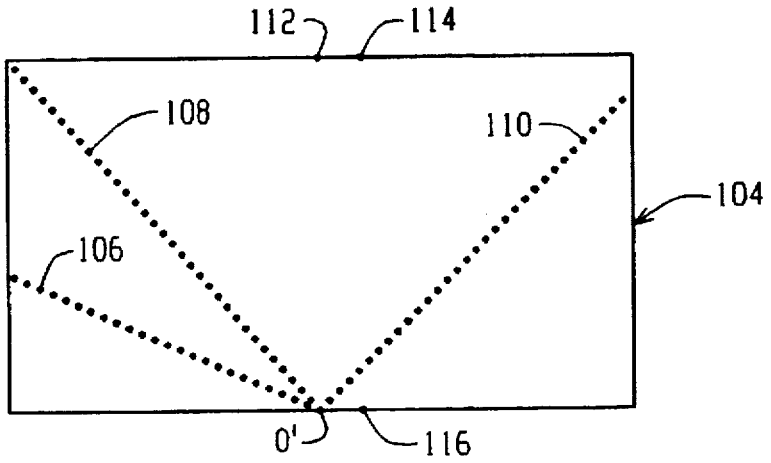

FIG. 21 is a view of the print area 104, and the three rows of dots 106, 108 and 110 projected by the print head 99 as it rotates about an axis 0' centered on one side of the printing area 104. A second print head (not shown), printing for example a second color, can be located on the opposite side of the printing area 104 if so desired, on an axis 112. This configuration likewise uses a 180° rotation of the print head(s) 99. The print head 99 axes may be displaced towards one end of the print area, to allow for the introduction of two additional print heads on axes 114 and 116 as shown. This will allow printing with up to four separate print heads, and four colors.

Figure 22:
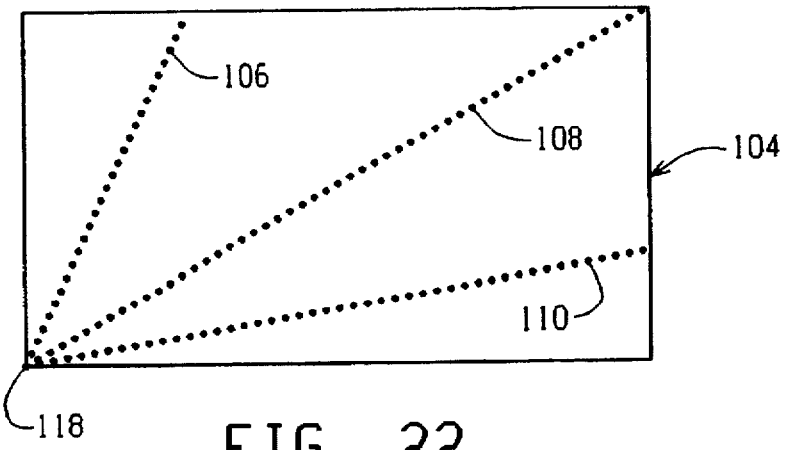

FIG. 22 is a view of the printing area 104, and three rows of dots 106, 108 and 110 projected by a print head 99 as it rotates about an axis located at a corner 118 of the printing area 104. Additional print heads may be located at the other corners of the print area if so desired. In this configuration, print head rotation of just 90° can be used to scan the entire printing area.

With this embodiment it is recognized that any number of positions may be selected for the placement of the print head relative to the medium in addition to those described. Considerations include the number of nozzles required, the angle of rotation required, and the maximum distance over which ink droplets must be projected. Similarly, it is recognized that a number of means are available to achieve rotation of the print head(s) as described. Such means include electric motors, voice coil actuators, solenoids, and the like, as well as various mechanical linkages and mechanisms.

Figure 23:
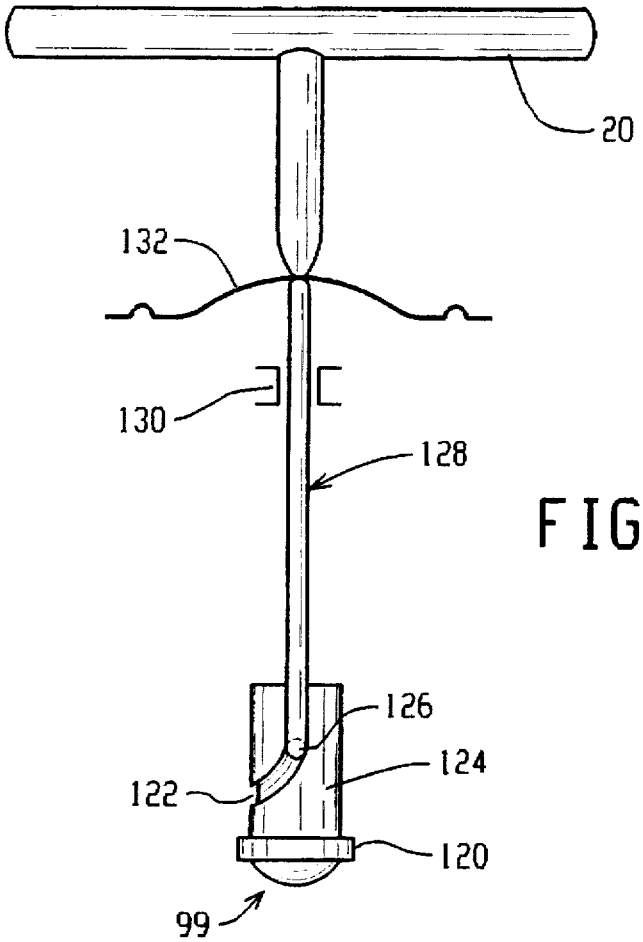

A bistable spring apparatus as shown in FIGS. 10A and 10B may, for example, be adapted to produce rotary motion. This is shown schematically in FIG. 23, where a rotary ink jet print head 99 is supported by bearing 120. A spiral groove 122 in the body 124 of the print head 99 slidably receives a guide pin 126 protruding from a rod 128, which is constrained to move vertically by a bushing 130 attached to the housing 12 (housing 12 not shown in FIG. 23 for clarity). The rod 128 is attached to a bistable spring 132, which may be similar to the bistable spring 84 described hereinabove with respect to FIGS. 10A and 10B. When the actuator handle 20 is depressed by the operator, bistable spring 132 snaps abruptly into an alternate position, as previously described with regard to FIG. 10B. The rod 128 and 0 pin 126 are driven down, resulting in a rotation of print head 99. When actuator handle 20 is released, the bistable spring 132 returns to its initial position, pulling up the rod 128 and pin 126, thereby rotating print head 99 back to its initial or home position.

Figure 24:
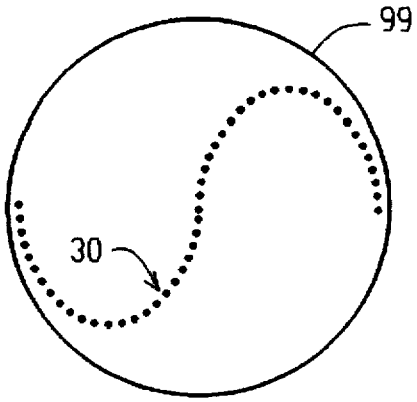
Figure 25:
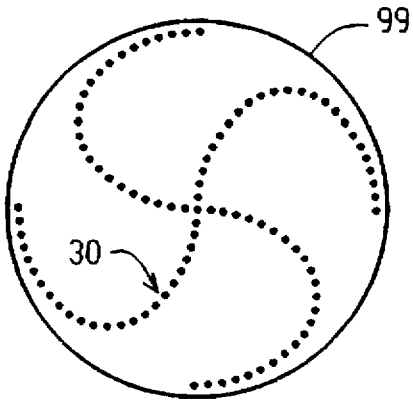

It is of further note that the ink jet print head 99 nozzles 30 need not be linearly disposed along the print head, but may, if so desired for ease of manufacture or any other purpose, be distributed in some useful pattern as shown in FIGS. 24 or FIG. 25. Multiple identical sets of nozzles may be used to reduce the angle of rotation required for full coverage of the print area. Two identical sets of nozzles, for example, would reduce the required print head rotation in half.

Figure 26:
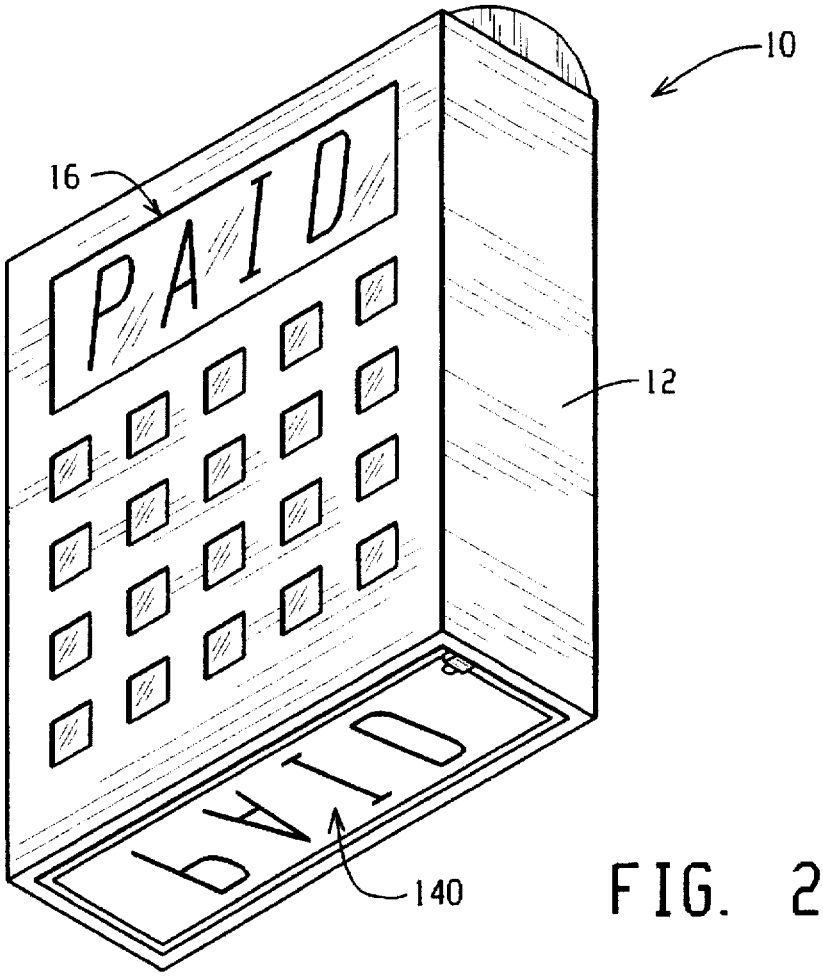
FIGS. 26–29 illustrate an alternative embodiment of the invention using an intermediate transfer ink jet printing mechanism.

With reference next to FIG. 26, the printer mechanism can also be realized in the form of a printer equipped with a flat plate type intermediate transfer ink jet printing device. In this embodiment an ink jet print head does not print directly on the print medium, but rather prints on an intermediate transfer medium. This transfer medium is then brought into contact with the print medium to effect the transfer of the image. A print head capable of printing the full width of the print area is used.

In FIG. 26, the printer is shown with the exemplary display 16 reading "PAID," indicating that as the image which is about to be transferred to the print medium, and the same image is shown on the transfer plate 140, already in the print position. Note that printing on the transfer medium will be inverted, because it will be reversed (and thus read properly) when transferred to the print medium.

Figure 27:
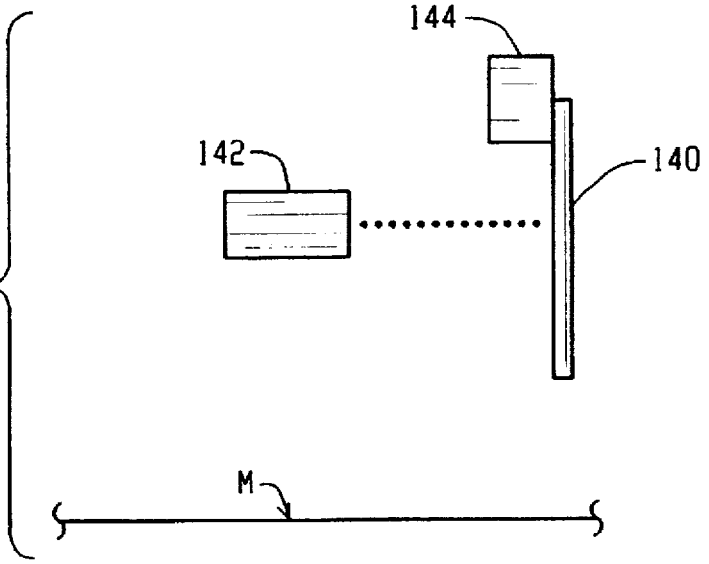

FIG. 27 is a schematic view showing a print head 142, an intermediate transfer plate 140 and the print medium M. In operation, the transfer plate 140 is pushed down vertically past the print head 142 as shown. Further motion tips the plate down into a horizontal position, and then into contact with the print medium.

A cleaning pad 144 wipes any excess ink from the transfer plate 140 on its upward return, and again on its down stroke for the next printing. This cleaning pad 144 can be an absorbent material such as cotton, and should be changed periodically. This is accomplished by changing this pad when the ink supply is renewed. This can be facilitated by incorporating the cleaning pad 144 into an ink cartridge/print head assembly so that the ink supply, print head, and cleaning pad are all renewed at the same time.

Transfer plate 140 is made of a non-absorbent material. Excellent results have been obtained with both metal and vinyl surfaces, with nearly complete transfer of ink to the print medium, with very little residue left to be removed by the cleaning pad 144.

Figure 28:
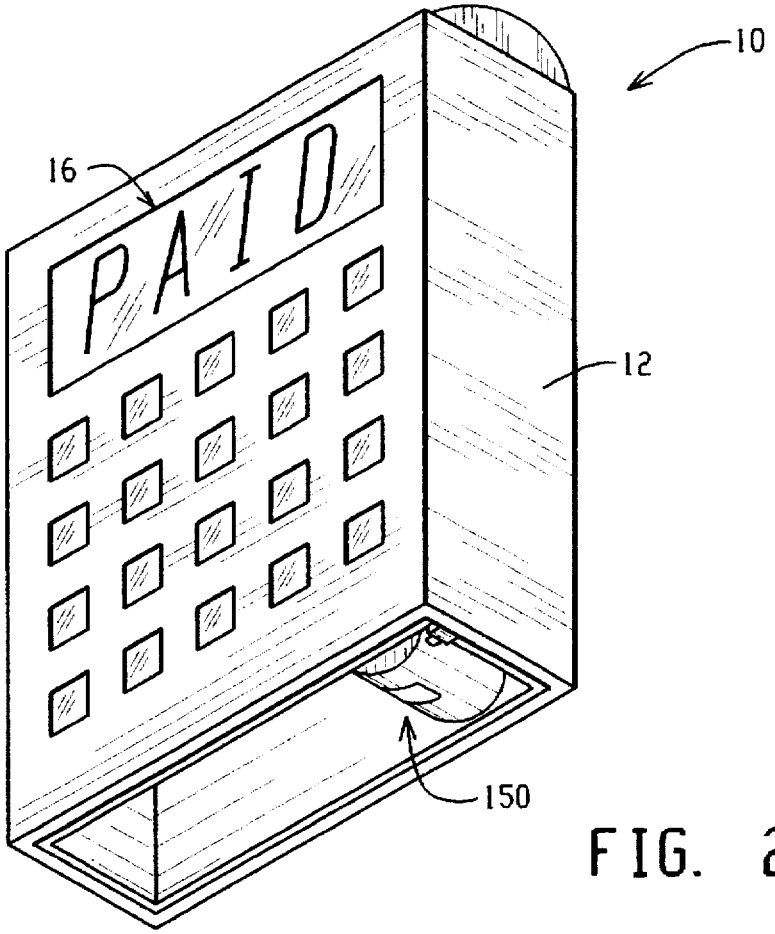

FIG. 28 is a bottom facing perspective view of a printer equipped with a roller type intermediate transfer ink jet printer mechanism 150. This is similar to the flat plate type just described, but here the transfer mechanism is a roller 150, rather than a flat plate. Transfer is effected by a rolling action against the print medium.

Figure 29:
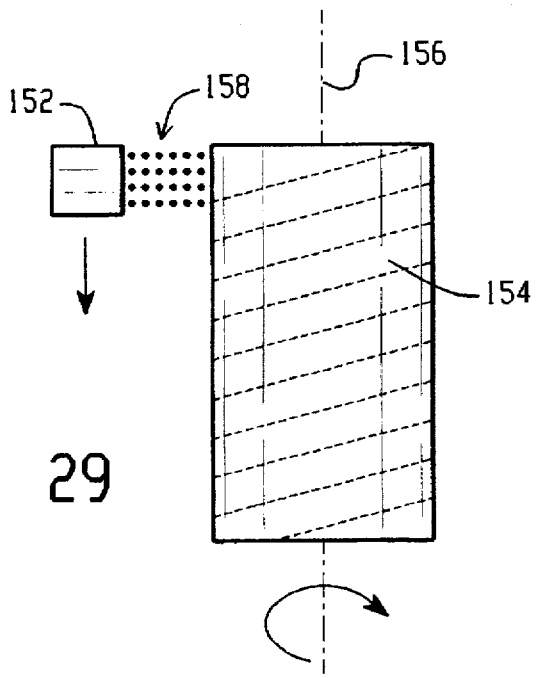

In still a further alternative, FIG. 29 illustrates a printer apparatus 10 equipped with a helical scanning roller type intermediate transfer ink jet print mechanism. This is similar to the roller transfer type just described, but here the ink jet print head is not capable of printing the full width of the print area, but rather just a small swath such as ⅛" or so, as is typical of ink jet print heads manufactured for inexpensive printers. Such a print head is, for example, Hewlett-Packard part number 51604A. By means of helical scanning as herein described such a narrow swath print head can print the full area of the transfer roller.

This embodiment utilizes a transfer roller that is large enough so as to be able to receive the entire matter to be printed prior to transfer to the print medium. If the print area is 2"×3", for example, the transfer roller may be 2" long and with a circumference of at least 3", corresponding to a diameter of at least 0.955".

FIG. 29 is a schematic view from the top of such a helical scan printing mechanism showing a print head 152 and a transfer roller 154. As the transfer roller 154 rotates about an axis 156 as shown, the print head 152 traverses the width of the roller. The print head 152 has a plurality of nozzles capable of printing a narrow swath as indicated by the projected ink droplets 158. This traverse of the print head 152 in conjunction with the rotation of the transfer roller 154 results in helical scanning of the roller 154 as shown.

The print head 152 can be moved or translated adjacent the transfer roller 154 by any convenient means such as a conventional motor drive as is well known, or the print head 152 may sweep over the transfer roller surface using a mechanical sweep mechanism as described with regard to FIGS. 8 and 10A, 10B herein. Whatever traverse means is used, the traverse of the print head 152 is synchronized with the rotation of the transfer roller 154 such that the print head is advanced by the width of one print swath for each revolution of the transfer roller. If, for example, the print swath is ⅛", and the width of the print area (and thus the roller) is 2", then the print head traverses 1/8" for each revolution of the roller, and the roller makes 16 revolutions for complete printing.

Only after the transfer roller is completely printed does transfer to the print medium take place, hence this embodiment essentially involves a two step printing process. First, the transfer roller is rotated and the print head traversed to complete the process of printing the information on the transfer roller. Next, the transfer roller is brought into contact with the print medium and rolled through one complete revolution to effect transfer to said print medium.

As further enhancements to the utility and flexibility of the self-contained hand-held printing apparatus described hereinabove, those skilled in the art will appreciate that the use of an internal control circuit, such as the circuit 40 herein that uses a microprocessor 42 and memory circuit 46, facilitates incorporating additional user functions with the hand-held printer apparatus 10. Such additional features will now be described in terms of additional exemplary embodiments of the invention, including a calculator, personal organizer functions, voice recording and play back, voice recognition and synthesis and postage meter functions.

The hand-held printer apparatus 10 as previously disclosed hereinabove permits implementation of a calculator, with the use of appropriate software for the microprocessor 42. Similarly, implementation of a personal organizer is available with the use of appropriate software well known to those skilled in the art. The device may, for example, function as a printing calculator. In a further example, using the personal organizer capabilities, names and addresses can be retrieved from a data base stored in the memory 46, sorted, selected and then printed on envelopes.

Figure 30A:
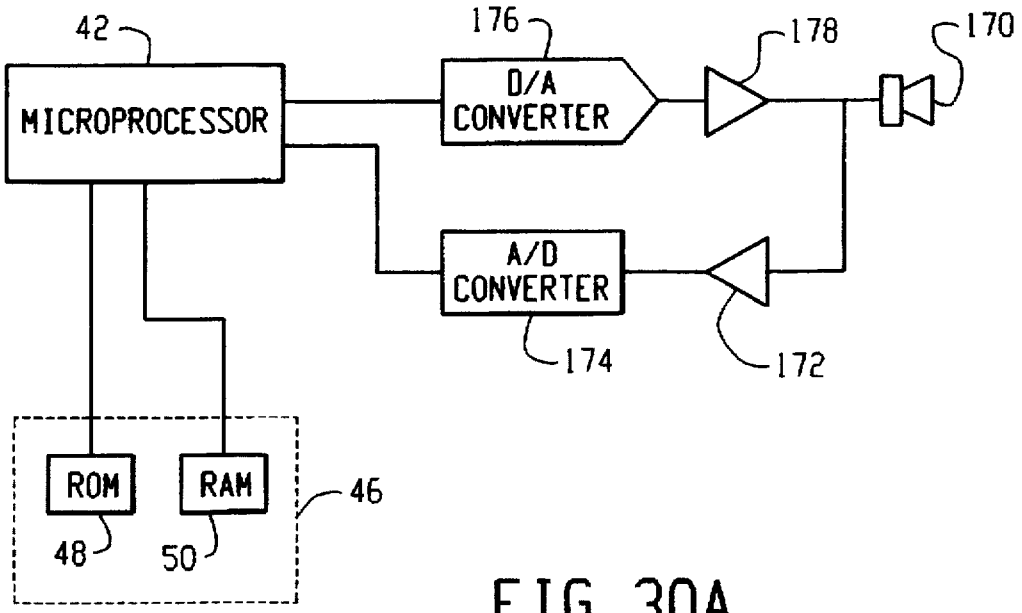
FIGS. 30A and 30B are simplified block diagrams of suitable alternative circuits for implementing voice functions with a printing apparatus, in accordance with the invention.

Referring to FIG. 30A, with the addition of a suitable transducer 170, amplifiers 172, 178, an analog to digital converter (A/D converter) 174, and a digital to analog converter (D/A converter) 176, the hand-held printer 10 gains the capability to serve as an audio recording and playback device. The recording time available will be limited only by the amount of memory available.

A suitable transducer 170 is a simple electromagnetic speaker or microphone, or a ceramic or crystal piezoelectric element, or any of various other devices commercially available, such as model WM-70S1 available from Panasonic. A single transducer may serve as both speaker and microphone, or two separate transducers may be used. When recording, the transducer 170 functions as a microphone, whose signal may be boosted to an appropriate level by the amplifier 172, the output of which is applied to the A/D converter 174. The A/D converter 174 converts the analog signal into digital form which can be stored in memory 46 by the microprocessor 42. At playback, the opposite process takes place, with the microprocessor 42 reading the stored digital message from memory, and applying the digital signal to the D/A converter 176. The output of the D/A converter 176 is an analog signal which is then amplified by an amplifier 178 to an appropriate level and applied to the transducer 170, which now functions as a speaker. The amplifiers 172,178 may be selected from any of a suitable solid-state integrated circuit devices made for such purposes, and may, in fact, be integrated with their respective converters. Similarly, the A/D and D/A converters may be standard devices readily available and well-known. Some microprocessors contain such converters as an integral part, in which case separate devices are not needed.

Figure 30B:
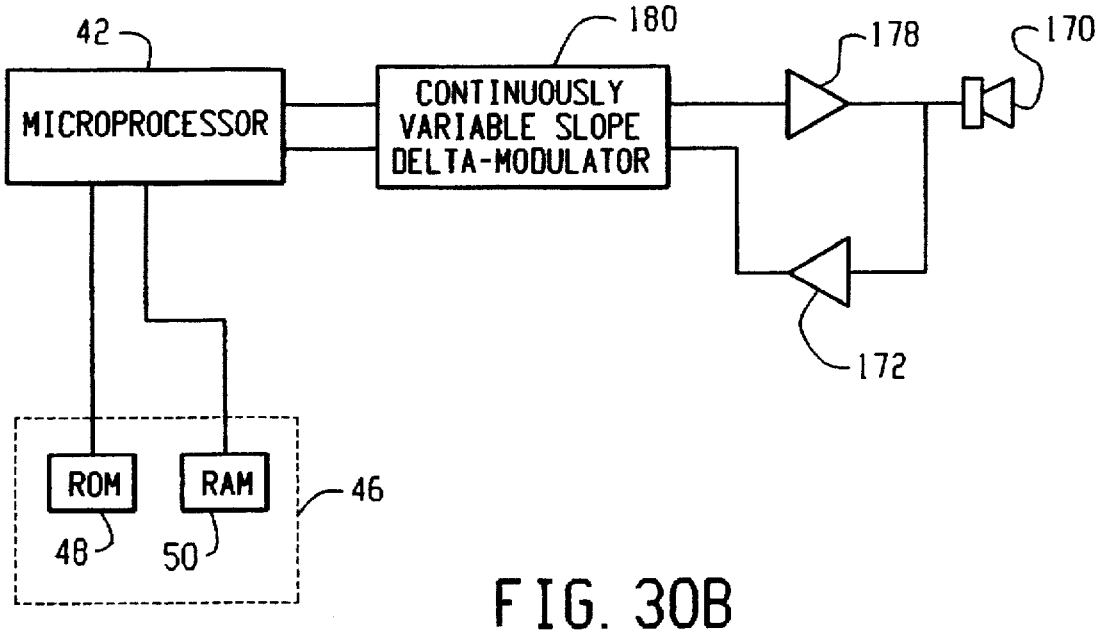

With reference to FIG. 30B, a delta-modulation technique provides an alternative and efficient method for audio signal digitization with reduced data rate and memory size requirements. An integrated circuit continuously variable slope delta-modulator 180 performs the A/D and D/A conversion functions with delta modulation, as well as automatic gain control. A suitable device for the circuit 180 is part no. HC-55564 available from Harris Corporation.

Further, with appropriate voice recognition software, the apparatus 10 can be made responsive to voice commands. For example, the spoken phrase "print confidential" would cause the device to retrieve the word CONFIDENTIAL from its memory and set itself to print that word. Similarly, voice synthesis software could be used to provide spoken communications from the printer to the user, such as, for example, "ink supply is low."

The hand-held printer 10 as described can further be provided with additional features so as to function as a postage meter.

Figure 31A:
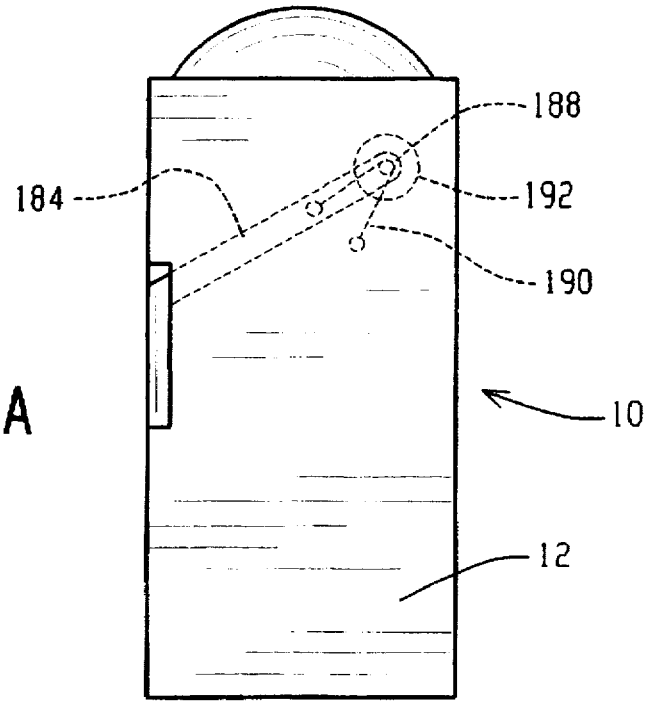
FIGS. 31A and 31B are simplified schematics of an embodiment of the invention for use as a postage meter.
Figure 31B:
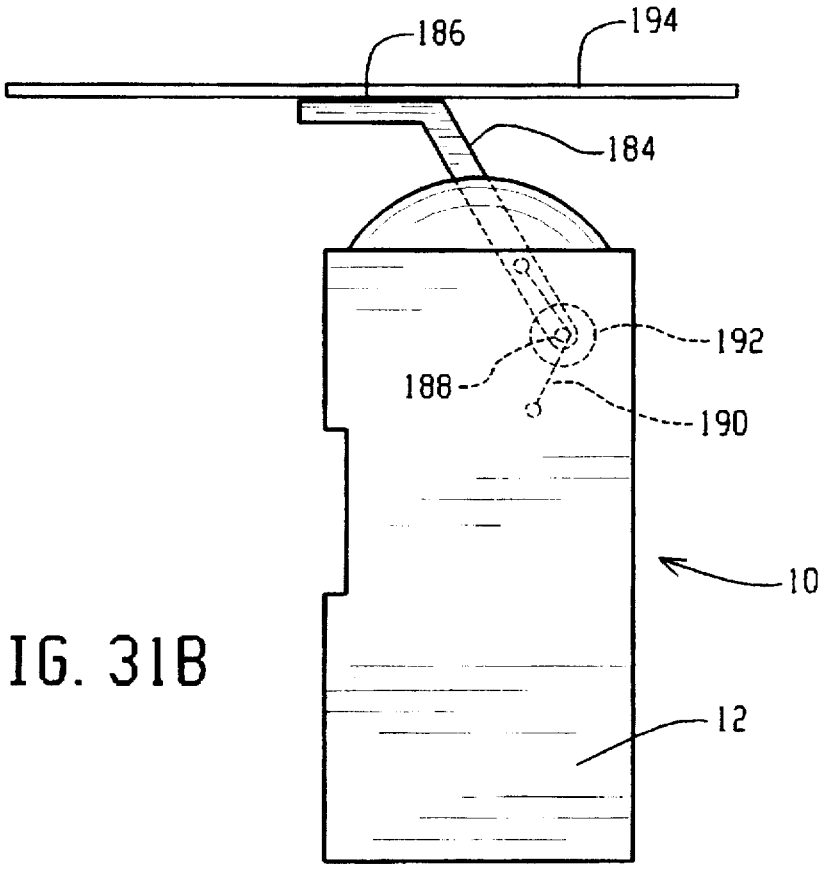

With reference to FIGS. 31A and 31B, in performing the function of a postage meter, the printer apparatus 10 prints a postage indicia in an appropriate amount, and deducts the amount of postage from a memory register which has previously been loaded with a purchased amount of postage. The postage meter imprint may include a logo and/or advertising message as may be permitted by postal regulations, with the logo or advertising message having been stored in memory 46 using the printer's interface or I/O interconnection circuits as has been described herein.

Appropriate devices and circuits can be included to load the memory register with postage in a secure manner, such that postage can be added to the register only when it has been properly purchased, as is known.

The amount of postage required to be imprinted on a particular item may be manually entered via the key pad, or, alternately, may be determined directly by the printer device when it is equipped with a suitable weighing mechanism. A suitable weighing mechanism is a load cell as is well-known, or a calibrated spring as is well-known. Where a calibrated spring is utilized, any weight will result in a displacement of a specific amount, where the displacement can be measured by an optical encoder, a linear variable displacement transducer (LVDT), a potentiometer or other device as are well-known.

The weighing mechanism supports an article 194 to be weighed, such that the weight can be determined. This support function may take many forms, such as, for example, a platform 184 which folds out from the back of the printer 10, as shown in FIGS. 31A and 31B. When not in use, the platform 184 is held in the stowed position as in FIG. 31A by a latch or other convenient device (not shown). In use, the platform 184 is deployed as illustrated in FIG. 31B, with the printer 10 placed on a surface as shown, and the article to be weighed placed upon the flat surface 186 provided on the platform 184. A torsion spring 190 is attached at one end to the housing 12, and at its other end to the platform 184. The torsion spring 190 reacts to the weight of the article, and the platform 184 is depressed by an amount which is a function of the weight of the article. This movement is measured or detected by an encoder 192 at the platform's pivot point 188 and input to the microprocessor 42 which then computes or otherwise determines the weight and the required postage by referring to postal rate data stored in the memory 46 or other memory device. The platform 184 is then stowed as in FIG. 31A, and the printer 10 can be actuated in the manner described in the exemplary embodiments herein, to print the postage indicia on the medium.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

I claim:

1. A hand-held and self contained electronic printing device for printing indicia on a medium, comprising: a housing that can be manually positioned adjacent a surface of the medium and remain stationary against the medium during a print sequence; a printer disposed in the housing for printing indicia on the medium, the printer comprising a print head movable between first and second positions within the housing; an actuator for controlling application of a force that moves the print head from said first position to said second position; a spring operatively connected to the print head to move the print head from said first position to said second position in response to the actuator; and electronic control means disposed in the housing for controlling the printer to print indicia on the medium during at least part of the movement of the print head from the first to the second position.

2. The apparatus of claim 1 wherein said print head scans a print area on said surface of the medium during movement thereof between said first and second positions.

3. The apparatus of claim 2 wherein said print head is moved along an arcuate path between said first and second positions.

4. The apparatus of claim 2 wherein said print head is rotated about an axis between said first and second position.

5. The apparatus of claim 3 wherein said actuator comprises a handle with said spring attached at one end to said print head and at another end to the housing, said handle displacing the spring to move said print head from said first to said second position when said handle is manually pressed down in a stamping-like motion.

6. The apparatus of claim 5 further comprising a magnet in said housing, said magnet holding said spring at said first position, said handle disengaging said spring from said magnet when manually actuated.

7. The apparatus of claim 1 further comprising user interface means for inputting print and indicia commands to a memory disposed in said housing.

8. The apparatus of claim 1 wherein print head comprises a number of ink jet nozzles.

9. The apparatus of claim 1 further comprising means for sensing and indicating correct position of said print head with respect to the medium to enable a print sequence.

10. The apparatus of claim 8 wherein said nozzles are disposed to project ink droplets on divergent trajectories with respect to each other.

11. The apparatus of claim 10 wherein said electronic control means compensates to reduce distortion in a printed indicia caused by said divergent trajectories.

12. The apparatus of claim 1 wherein said electronic control means compensates to reduce distortion in a printed indicia caused by movement of said print head along a path that is other than parallel to said surface of the medium.

13. A hand-held and self contained electronic printing device for printing indicia on a medium, comprising: a single housing that is manually held stationary against a surface of the medium during a printing sequence; a printer disposed in said single housing for printing indicia in any selectable pattern on the medium during said printing sequence; an actuator for initiating said printing sequence; and electronic control means disposed in said single housing and responsive to said actuator for controlling the printer to print selected indicia on the medium during said printing sequence; the printing device autonomously executing each entire printing sequence after each printing sequence is initiated.

14. The apparatus of claim 13 wherein said control means comprises a memory that electronically stores a plurality of selectable indicia that can be selected for printing during a printing sequence.

15. The apparatus of claim 14 further comprising input means disposed in the housing for an operator to select a number of said stored indicia for printing.

16. The apparatus of claim 15 wherein said input means comprises a keypad and visual display devices that are used by the operator to create an indicia pattern to be printed.

17. The apparatus of claim 14 wherein said memory stores a control program and instructions such that the apparatus is manually operational in a stand alone configuration independent of electronic input controls from an external source.

18. The apparatus of claim 13 further comprising communications means disposed in the housing for transmitting instructions, commands and data between said apparatus and an external control device.

19. The apparatus of claim 18 wherein the external device comprises a personal computer.

20. The apparatus of claim 18 wherein said communication means comprises a wireless link between said apparatus and the external device.

21. The apparatus of claim 18 wherein said communication means includes a device selected from the group consisting of: an RF transceiver, acoustic transceiver, optical transceiver, modem, serial port and parallel port.

22. The apparatus of claim 13 wherein said printer comprises an ink jet printer that remains stationary during a print sequence.

23. The apparatus of claim 13 wherein said printer comprises a print head having a number of nozzles, said print head being movable between first and second positions along a path that is generally not parallel to a plane of the printing area.

24. The apparatus of claim 23 wherein said nozzles are disposed on said print head to project ink at diverging angles with respect to each other.

25. The apparatus of claim 23 further comprising means for compensating distortion caused by movement of the nozzles along said non-parallel path.

26. The apparatus of claim 23 further comprising electric means for moving said print head.

27. The apparatus of claim 23 further comprising means for applying a manual force to said print head to move said head from said first to said second position.

28. The apparatus of claim 13 wherein said printer comprises a print head having a number of nozzles disposed to print on an intermediate transfer medium.

29. The apparatus of claim 13 wherein said printer comprises a print head that rotates about an axis.

30. The apparatus of claim 13 wherein said control means accumulates a total count of dots printed by said printer and produces an output indicating low ink supply based on said accumulated total count.

31. The apparatus of claim 13 wherein said control means accepts a plug-in module for transferring information between the apparatus and an external source.

32. The apparatus of claim 13 further comprising a sensor that enables a print sequence when the apparatus is correctly positioned with respect to the medium.

33. The apparatus of claim 13 wherein said printer includes means for printing indicia in a number of colors.

34. The apparatus of claim 24 further comprising means for compensating distortion caused by projection of ink by nozzles disposed at diverging angles with respect to each other.

35. The apparatus of claim 24 further comprising compensation for distortion caused by projection of ink by nozzles disposed at diverging angles with respect to each other.

36. The apparatus of claim 29 further comprising means for compensating distortion caused by polar coordinate projection of ink by nozzles disposed at diverging angles with respect to each other.

37. The apparatus of claim 13 further comprising a weight device stowed in said housing for weighing an article, wherein said control means computes a postage value based on said measured weight for printing on said medium.

38. The apparatus of claim 37 wherein said weight device includes a platform pivotally retractable from said housing that supports an article to be weighed.

39. The apparatus of claim 38 further comprising displacement means for determining weight of an article as a function of displacement of said platform when the article is placed thereon.

40. The apparatus of claim 13 further comprising means for audio input, audio storage and audio output.

41. The apparatus of claim 13 wherein said printer is entirely disposed in said single housing and comprises a linear array of nozzles.

42. The apparatus of claim 41 wherein said linear array of nozzles comprises a single line of a plurality of ink jet nozzles.

43. The apparatus of claim 13 wherein said printer is entirely disposed in said single housing and comprises a plurality of ink jet nozzles wherein each nozzle projects an ink dot onto the medium, within a printing area defined by the housing, along a trajectory that is fixed by the position of the nozzle within the housing when the nozzle is activated by the electronic control means.

44. The apparatus of claim 13 wherein said printer comprises an areal array of ink jet nozzles positionally fixed within said housing during a printing sequence, wherein each ink jet nozzle projects an ink dot to a predetermined dot position in a printing area defined by the housing.

45. The apparatus of claim 43 wherein said printer comprises a print head that moves from a first position to a second position during a printing sequence, the print head comprising said nozzles, the apparatus further comprising means for determining position of each nozzle during a printing sequence and means for dynamically selecting said nozzles for printing a dot pattern on the medium as a function of said detected positions and the image to be printed.

46. The apparatus of claim 43 wherein said nozzles project ink at diverging angles with respect to each other.

47. The apparatus of claim 45 wherein distance between said print head and the medium varies during a printing sequence.

48. The apparatus of claim 45 wherein an angular relationship between said print head and the medium varies during a printing sequence.

49. The apparatus of claim 45 wherein the print head moves in an arcuate path from said first to said second position.

50. The apparatus of claim 13 wherein the indicia to be printed is stored in a memory within said housing, said electronic control means controlling the printer using an algorithm to compensate for printed image distortion caused by movement of the printer within the housing during a printing sequence.

51. The apparatus of claim 50 wherein said printer comprises a plurality of printing elements each of which ejects ink at diverging angles with respect to the others, and wherein the control means algorithm includes the step of controlling which printing elements are activated to position a dot at a selected position in the printing area based on the detected positions of the printing elements during a printing sequence.

52. The apparatus of claim 13 wherein said printer comprises a number of print elements each of which operates to print a portion of a respective fixed pattern on the medium during a printing sequence.

53. The apparatus of claim 28 wherein said intermediate transfer medium is a flat plate.

54. The apparatus of claim 28 wherein said intermediate transfer medium is a roller.

55. The apparatus of claim 54 wherein said roller is helically scanned.

* * * * *

UNITED STATES PATENT AND TRADEMARK OFFICE

CERTIFICATE OF CORRECTION

PATENT NO. : 5,634,730

DATED : June 3, 1997

INVENTOR(S) : Howard H. Bobry

It is certified that error appears in the above-indentified patent and that said Letters Patent is hereby corrected as shown below:

Column 9, line 33 after "30'" insert --.--.

Column 10, line 9 changing the correction to read--[ $^{(W-L)}/_{2H}$ ] .--

Column 12, line 14 after "and" delete "0".

Signed and Sealed this

Second Day of September, 1997

*Attest:*

*Attesting Officer*

Bruce Lehman

BRUCE LEHMAN

*Commissioner of Patents and Trademarks*

US005634730C1

(12) REEXAMINATION CERTIFICATE (4753rd)

United States Patent

Bobry

(10) Number: US 5,634,730 C1

(45) Certificate Issued: Mar. 25, 2003

(54) HAND-HELD ELECTRONIC PRINTER

(75) Inventor: Howard H. Bobry, 18416 Olympic View Dr., Edmonds, WA (US) 98020

(73) Assignee: Howard H. Bobry, Edmonds, WA (US)

Reexamination Request:
No. 90/005,840, Oct. 6, 2000

Reexamination Certificate for:

| | |
|---|---|
| Patent No.: | **5,634,730** |
| Issued: | **Jun. 3, 1997** |
| Appl. No.: | **08/554,042** |
| Filed: | **Nov. 6, 1995** |

Certificate of Correction issued Sep. 2, 1997.

(51) Int. Cl.[7] ..... B41J 3/39

(52) U.S. Cl. ..... 400/88; 346/143; 358/473

(58) Field of Search ..... 400/88; 101/110; 347/109

(56) References Cited

U.S. PATENT DOCUMENTS

| | | | | |
|---|---|---|---|---|
| 4,699,052 A | | 10/1987 | Lemelson | |
| 4,903,232 A | | 2/1990 | O'Connell | |
| 5,024,541 A | * | 6/1991 | Tsukada et al. | 400/88 |
| 5,206,490 A | | 4/1993 | Petigrew et al. | |
| 5,267,800 A | * | 12/1993 | Petteruti et al. | 400/88 |
| 5,475,403 A | * | 12/1995 | Havlovick et al. | 346/134 |

FOREIGN PATENT DOCUMENTS

| | | | |
|---|---|---|---|
| DE | 3142937 A1 | DD | 5/1983 |
| EP | 0449157A1 | DD | 10/1991 |
| EP | 0564297 A2 | DD | 10/1993 |
| EP | 0598251 | DD | 5/1994 |

* cited by examiner

*Primary Examiner*—Andrew Hirshfeld

(57) ABSTRACT

A hand-held and self contained electronic printing device for printing indicia on a medium includes a housing that can be manually positioned adjacent a surface of the medium and remain stationary against the medium during a printing sequence; the housing having an aperture that generally defines a printing area on the medium when the housing is in position for printing; a printer disposed in the housing for printing indicia in a selectable pattern of dots on the medium within the printing area; an actuator for initiating a printing sequence; and electronic control means disposed in the housing for controlling the printer to print indicia on the medium during a printing sequence. In one embodiment, the print head can be moved to sweep across a printing area by a manual force applied to an actuator.

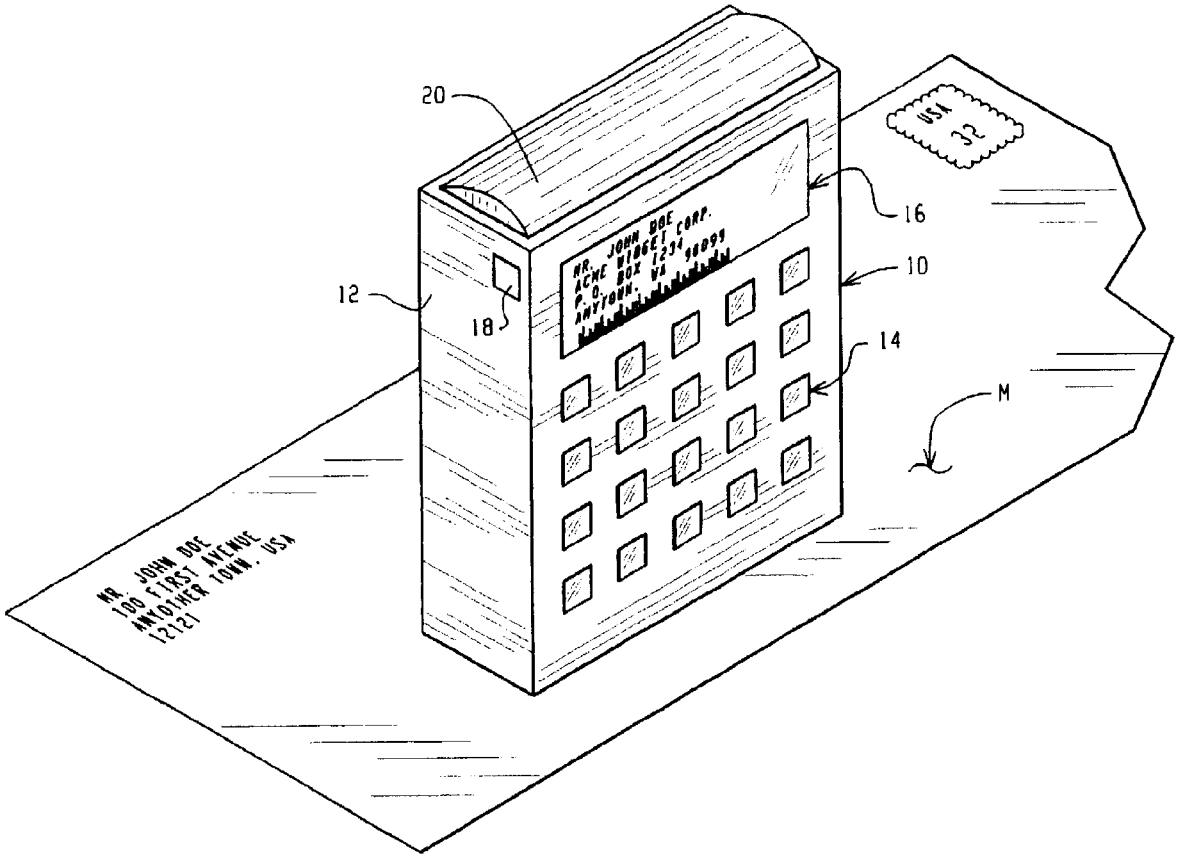

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–12 is confirmed.

Claims 22 and 44 are cancelled.

Claims 13–14, 18, 23, 28–29, 31–33, 41, 43 and 51–52 are determined to be patentable as amended.

Claims 15–17, 19–21, 24–27, 30, 34–40, 42, 45–50 and 53–55, dependent on an amended claim, are determined to be patentable.

New claim 56 is added and determined to be patentable.

13. A hand-held and self contained electronic printing device for printing indicia *within a printing area* on a medium *external to the printing device*, comprising:

a single housing that is manually held stationary against a surface of the medium [during] *throughout* a printing sequence*, the housing having an aperture that delimits said printing area and through which printing is accomplished*;

a printer disposed in said single housing [for] *and capable of* printing indicia in any selectable pattern *within the printing area* on the medium during said printing sequence*, said printer comprising a print head that is moved from a first position to a second position during said printing sequence*;

an actuator for initiating said printing sequence; and electronic control means *responsive to said actuator* disposed in said single housing and [responsive to said actuator for controlling the printer to print selected indicia on the medium during said printing sequence] *having a memory that electronically stores the indicia to be printed as a digitized representation of a plurality of lines of dots, said electronic control means monitoring motion of said print head and using an algorithm to read said representation and control said print head motion so as to print said indicia as an uninterrupted pattern on the medium during said printing sequence*;

the printing device autonomously executing each entire printing sequence after each printing sequence is initiated.

14. The apparatus of claim [13] *56* wherein said control means comprises a memory that electronically stores a plurality of selectable indicia that can be selected for printing during a printing sequence.

18. The apparatus of claim [13] *56* further comprising communications means disposed in the housing for transmitting instructions, commands and data between said apparatus and an external control device.

23. The apparatus of claim [13] *56* wherein said printer comprises a print head having a number of nozzles, said print head being movable between first and second positions along a path that is generally not parallel to a plane of the printing area.

28. The apparatus of claim [13] *56* wherein said printer comprises a print head having a number of nozzles disposed to print on an intermediate transfer medium.

29. The apparatus of claim [13] *56* wherein said printer comprises a print head that rotates about an axis.

31. The apparatus of claim [13] *56* wherein said control means accepts a plug-in module for transferring information between the apparatus and an external source.

32. The apparatus of claim [13] *56* further comprising a sensor that enables a print sequence when the apparatus is correctly positioned with respect to the medium.

33. The apparatus of claim [13] *56* wherein said printer includes means for printing indicia in a number of colors.

41. The apparatus of claim [13] *56* wherein said printer is entirely disposed in said single housing and comprises a linear array of nozzles.

43. The apparatus of claim [13] *56* wherein said printer is entirely disposed in said single housing and comprises a plurality of ink jet nozzles wherein each nozzle projects an ink dot onto the medium, within a printing area defined by the housing, along a trajectory that is fixed by the position of the nozzle within the housing when the nozzle is activated by the electronic control means.

51. The apparatus of claim [50] *56* wherein said printer comprises a plurality of printing elements each of which ejects ink at diverging angles with respect to the others, and wherein the control means algorithm includes the step of controlling which printing elements are activated to position a dot at a selected position in the printing area based on the detected positions of the printing elements during a printing sequence.

52. The apparatus of claim [13] *56* wherein said printer comprises a number of print elements each of which operates to print a portion of a respective fixed pattern on the medium during a printing sequence.

*56. A hand-held and self contained electronic printing device for printing indicia on a medium, comprising: a single housing that is manually held stationary against a surface of the medium during a printing sequence; a printer disposed in said single housing capable of printing indicia in any selectable pattern on the medium during said printing sequence; an actuator for initiating said printing sequence; and electronic control means disposed in said single housing and having a memory that electronically stores the indicia to be printed; said electronic control means controlling said printer using an algorithm to compensate for printed image distortion caused by movement of the printer within the housing during a printing sequence and responsive to said actuator for controlling the printer to print selected indicia on the medium during said printing sequence; the printing device autonomously executing each entire printing sequence after each printing sequence is initiated.*

* * * * *